US010213930B2

(12) United States Patent
Bady et al.

(10) Patent No.: US 10,213,930 B2
(45) Date of Patent: Feb. 26, 2019

(54) BEARD TRIMMER

(71) Applicant: Braun GmbH, Kronberg (DE)

(72) Inventors: Udo Bady, Steinbach (DE); Bernhard Sikora, Kelkheim (DE); Wolfgang Stegmann, Frankfurt am Main (DE); Matthias Wetzel, Schoeneck (DE); Juergen Behrendt, Brechen (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/716,446

(22) Filed: Sep. 26, 2017

(65) Prior Publication Data

US 2018/0085944 A1 Mar. 29, 2018

(30) Foreign Application Priority Data

Sep. 28, 2016 (EP) ..... 16191108

(51) Int. Cl.

| | |
|---|---|
| ***B26B 19/06*** | (2006.01) |
| ***B26B 19/04*** | (2006.01) |
| ***B26B 19/14*** | (2006.01) |
| ***B26B 19/20*** | (2006.01) |
| *B26B 19/38* | (2006.01) |

(52) U.S. Cl.

CPC ..... *B26B 19/063* (2013.01); *B26B 19/042* (2013.01); *B26B 19/046* (2013.01); *B26B 19/14* (2013.01); *B26B 19/20* (2013.01); *B26B 19/205* (2013.01); *B26B 19/386* (2013.01)

(58) Field of Classification Search

CPC ..... B26B 19/063; B26B 19/20; B26B 19/205; B26B 19/046; B26B 19/042; B26B 19/14; B26B 19/386

See application file for complete search history.

(56) References Cited

U.S. PATENT DOCUMENTS

| | | | | |
|---|---|---|---|---|
| 2,616,169 | A | 11/1952 | Reinout | |
| 2,880,504 | A | 4/1959 | Finn | |
| 3,107,423 | A | 10/1963 | Caesar | |
| 4,003,390 | A | 1/1977 | Solie | |
| 4,133,103 | A * | 1/1979 | Beck | B26B 19/12 30/346.51 |
| 4,630,370 | A * | 12/1986 | Hamada | B26B 19/14 30/346.51 |
| 5,259,115 | A * | 11/1993 | Bluder | B26B 19/20 30/201 |
| 5,937,526 | A * | 8/1999 | Wahl | B26B 19/20 30/200 |
| 9,731,424 | B1 * | 8/2017 | Holmes | B26B 19/02 |
| 2001/0004896 | A1 * | 6/2001 | Chaouachi | B26B 19/20 132/213.1 |
| 2016/0207208 | A1 * | 7/2016 | Tuijp | B26B 19/06 |
| 2017/0008180 | A1 * | 1/2017 | Nab | B26B 19/20 |
| 2017/0266823 | A1 * | 9/2017 | Whittaker | B26B 19/20 |
| 2017/0361476 | A1 * | 12/2017 | Phoon | B26B 19/20 |

FOREIGN PATENT DOCUMENTS

| | | |
|---|---|---|
| EP | 2481535 | 8/2012 |

OTHER PUBLICATIONS

European search report dated Mar. 28, 2017.

* cited by examiner

*Primary Examiner* — Sean Michalski

(74) *Attorney, Agent, or Firm* — Ronald T. Sia; Kevin C. Johnson

(57) ABSTRACT

A beard trimmer having a handle, a motor and a head portion. The head portion has a rotary cutting unit for trimming hair that is provided with a first outer cutter and a first inner cutter.

14 Claims, 23 Drawing Sheets

BEARD TRIMMER

FIELD OF INVENTION

The present disclosure relates to beard trimmers.

BACKGROUND OF INVENTION

Electric shaving apparatuses utilize various mechanisms to provide hair cutting functionality. Some electric shaving apparatuses have at least one perforated shaving foil and at least one undercutter which is constructed to be movable relative to the shaving foil. The shaving foil has a plurality of holes into which hairs thread themselves during the shaving operation. The undercutter is arranged in direct proximity to the shaving foil and is continually moved past the holes of the shaving foil during the shaving operation. As a result, the hairs which thread themselves into the holes of the shaving foil are severed by the undercutter. Such electric shaving apparatuses are intended to provide a clean shave. Some electric shaving apparatuses have rows of projected teeth that oscillate relative to one another, cutting hairs that are fed between the projected teeth. To adjust the cutting length, the user can attach a guard to increase the distance between the skin's surface and the projected teeth, thereby increasing the cut length of the hair.

Such electric shaving apparatuses may not be suitable for all users, such as users wishing to maintain hair at a length in between a close shave and a full beard, sometimes referred to as a stubble length. An electric shaving apparatus having perforated shaving foils, for instance, is configured to trim the hair at the skin's surface. Further, perforated shaving foils are generally not effective at cutting hairs exceeding a certain length, as feeding such hairs into the perforations of the shaving foil is difficult. While an electric shaving apparatus having projected teeth may be configured to receive a guard to set the trim length, the user of the electric shaving apparatus typically must orient the apparatus in many different positions relative to the skin during the shaving process in order to achieve the desired results. Such multiple orientations of the electric shaving apparatus are needed due to the arrangement of the projected teeth. More specifically, certain movement of the electric shaving apparatus relative to skin surface (i.e., across the grain) is required to properly thread the hairs into the gaps between the projected teeth so that the hairs can be cut.

Further, the disclosure of EP 2 481 535 A1 shows a shaving machine having a rotary cutting unit and a grid element which can releasably be attached onto the rotary cutting unit, so as to cut hair at a predefined distance from skin.

U.S. Pat. No. 2,880,504 A describes an electric razor to which a comb can be attached for cutting hair with a predefined length.

Thus, it would be advantageous to provide for an electric shaving apparatus with features that address one or more of these issues. Indeed, it would be advantageous to provide for an electric shaving apparatus that enables a user to achieve a desired look, such as a certain amount of stubble, while maintaining a desired ease of use and comfort level.

SUMMARY OF INVENTION

It is an object of the present invention to improve the ability of the user to use a dry shaving apparatus to trim hair to an even stubble length using a shaving-like regimen, while maintaining a desired ease of use and comfort. The present disclosure fulfills the needs described above by a beard trimmer having a handle, a motor and a head portion. The head portion comprises at least a rotary cutting unit for trimming hair that is provided with a first outer cutter and a first inner cutter. The first outer cutter is provided with a cutter skin contact surface and a cutting side which is opposite to the skin contact surface. The motor rotationally drives one or both of the first inner cutter and the first outer cutter in order to rotate relative to the other and suitable to cut hair between the first inner cutter and the first outer cutter. For example this means that either the first inner cutter or the first outer cutter is actively motor driven or both together relative to each other. A comb unit is releasably attached to the rotary cutting unit. The comb unit comprises comb teeth wherein each of the comb teeth has a tooth skin contact surface. The tooth skin contact surface is at an elevated level relative to the cutter skin contact surface so that the tooth skin contact surface is suitable to be brought in a skin contact and prevents the cutter skin contact surface to be brought in skin contact. A height difference of the tooth skin contact surface relative to the cutting side of the outer cutter defines a comb hair trimming length, characterized in that the comb teeth are more flexible when the comb unit is detached from the rotary cutting unit relative to the comb teeth being less flexible when the comb unit is attached to the rotary cutting unit. The rigidity of the comb teeth when the comb unit is attached to the rotary cutting unit beneficially provides limited or no variance in cutting length when the beard trimmer is used, such that the cutting length uniformity is substantially or completely independent of pressure applied by the user towards the skin and or by the pressure applied by the beard trimmer towards the skin. Several portions of the comb unit are supported and are resting on the rotary cutting unit and/or the adjacent rotary cutting unit housing sides so that a form fit of the inner side of the comb unit onto the attached portions which makes the per se flexible/bendable comb unit rigid and substantially non-flexible.

In order to increase comfort while limiting variance in cutting length, the comb unit is adapted to allow an amount of flexing of the comb teeth in a comb teeth zone of less than 0.6 mm, less than 0.4 mm, or less than 0.3 mm.

In order to further increase comfort, the comb unit is adapted to allow an amount of flexing of the comb teeth in a comb teeth zone which is located closest to a center of the outer cutter.

Preferably, the first comb unit is provided with an inner surface which faces the cutter skin contact surface and which is opposite to the tooth skin contact surface and wherein a distance between the cutter skin contact surface and the inner surface is below 0.6 mm, below 0.4 mm, or below 0.3 mm. Thus the uniformity of the cut length may vary by that minimal amount, even assuming that the user applies a highly varying pressure of the device onto the skin.

In order to increase the structural rigidity of the first comb unit, the comb unit comprises a circular wall, wherein the comb teeth are integrally connected with each other by the circular wall and wherein the circular wall is surrounding the sides of the rotary cutting unit.

In order to allow for the user to quickly and conveniently change trim length, the comb unit is releasably attached to the rotary cutting unit and/or the head portion is releasably attached to the handle.

In order to assist in directing hairs towards the first inner and outer cutter, the first inner cutter and/or the first outer cutter are driven by the motor to rotate in a rotary direction relative to each other and wherein the comb teeth of first comb unit are circularly arranged.

Preferably, the first comb unit is made of a thermoplastic material and more preferably the comb unit is made from Polyoxymethylene.

More preferably, the first comb unit is made of a material having an Elastic Modulus ranging between 1850 MPa and 3850 MPa or the Elastic Modulus ranges between 2350 MPa and 3350 MPa. Thus the comb unit with such an Elastic Modulus is sufficiently flexible to be connected e.g. via a snap fit connection and can be easily attached or removed.

BRIEF DESCRIPTION OF THE DRAWINGS

The above-mentioned and other features and advantages of the present disclosure, and the manner of attaining them, will become more apparent and the disclosure itself will be better understood by reference to the following description of nonlimiting embodiments of the disclosure taken in conjunction with the accompanying drawings, wherein.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION OF THE INVENTION

The present disclosure provides beard trimmers for maintaining a desired styling aesthetic, such as a 1-day beard, a 3-day beard, or a 5-day beard, for example. Various nonlimiting embodiments of the present disclosure will now be described to provide an overall understanding of the principles of the function, design and operation of the disclosed beard trimmers. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment may be combined with the features of other nonlimiting embodiments. Such modifications and variations are intended to be included within the scope of the present disclosure.

Figure 1:
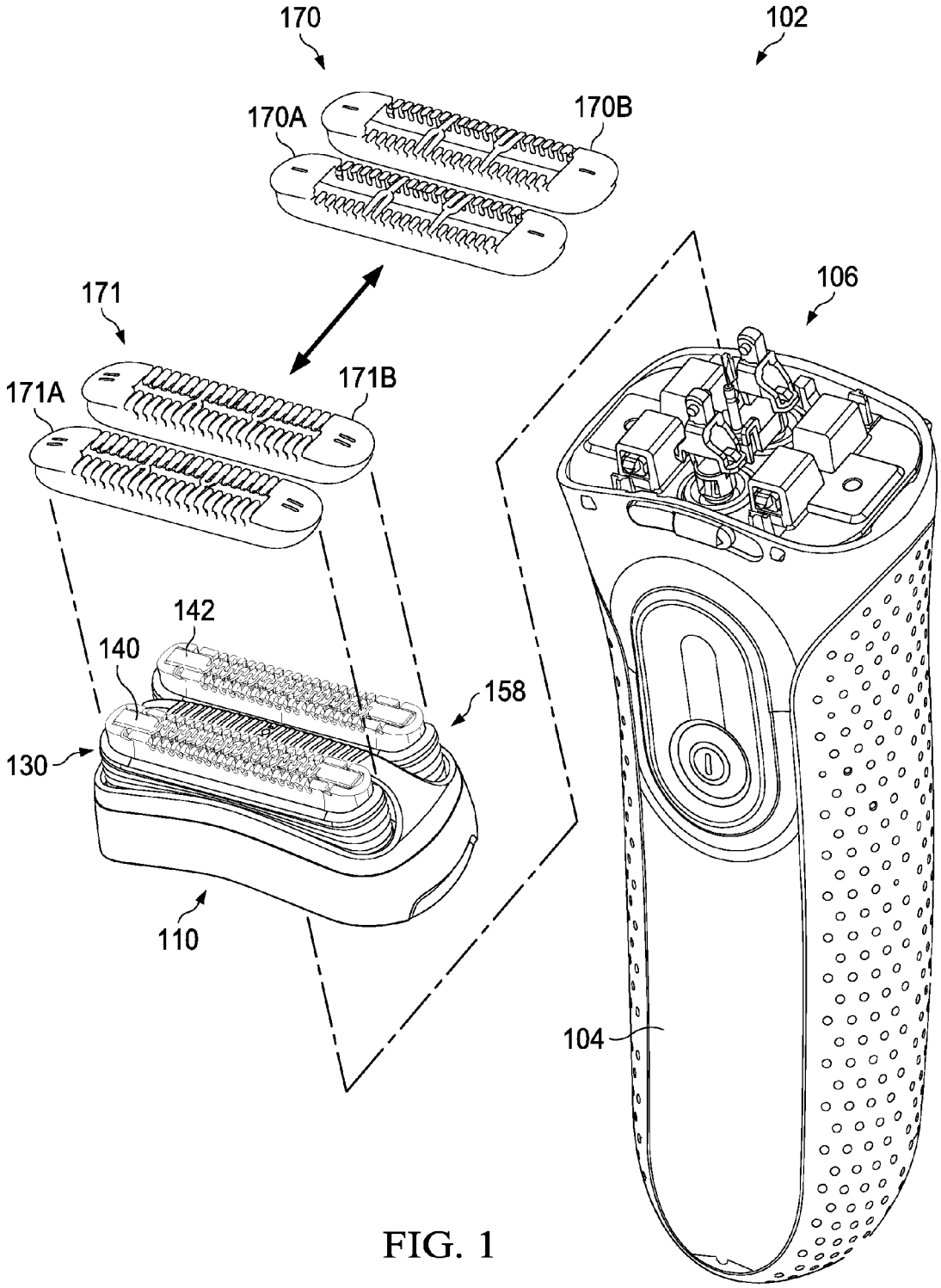
FIG. 1 is a front perspective view of a beard trimmer in accordance with one embodiment.

FIG. 1 is a front perspective view of a beard trimmer 102 having a head portion 110 in accordance with one embodiment. The beard trimmer 102 is shown as a dry shaving apparatus having a handle 104, which houses some or all of a motor 106 as well as other componentry, such as a power source, control circuitry, and so forth. The head portion 110 may be selectively coupled to the handle 104 (i.e., removable), such that when in a coupled position the motor 106 drives various features of the head portion 110. The head portion 110 comprises at least a first long hair cutter unit 130 for trimming hair. As described in more detail below, the length of the hair subsequent to trimming depends on whether a comb unit is attached to the first long hair cutter unit 130 and, if a comb unit is attached, the dimensions (i.e., thickness) of the attached comb unit. FIG. 1 depicts two example comb sets 170 and 171, each of which may be selectively attached to the head portion 110. As described in more detail below, each comb set 170 and 171 can offer a different trim length. In the illustrated configuration, for instance, comb set 170 provides a shorter trim length than comb set 171.

Figure 2:
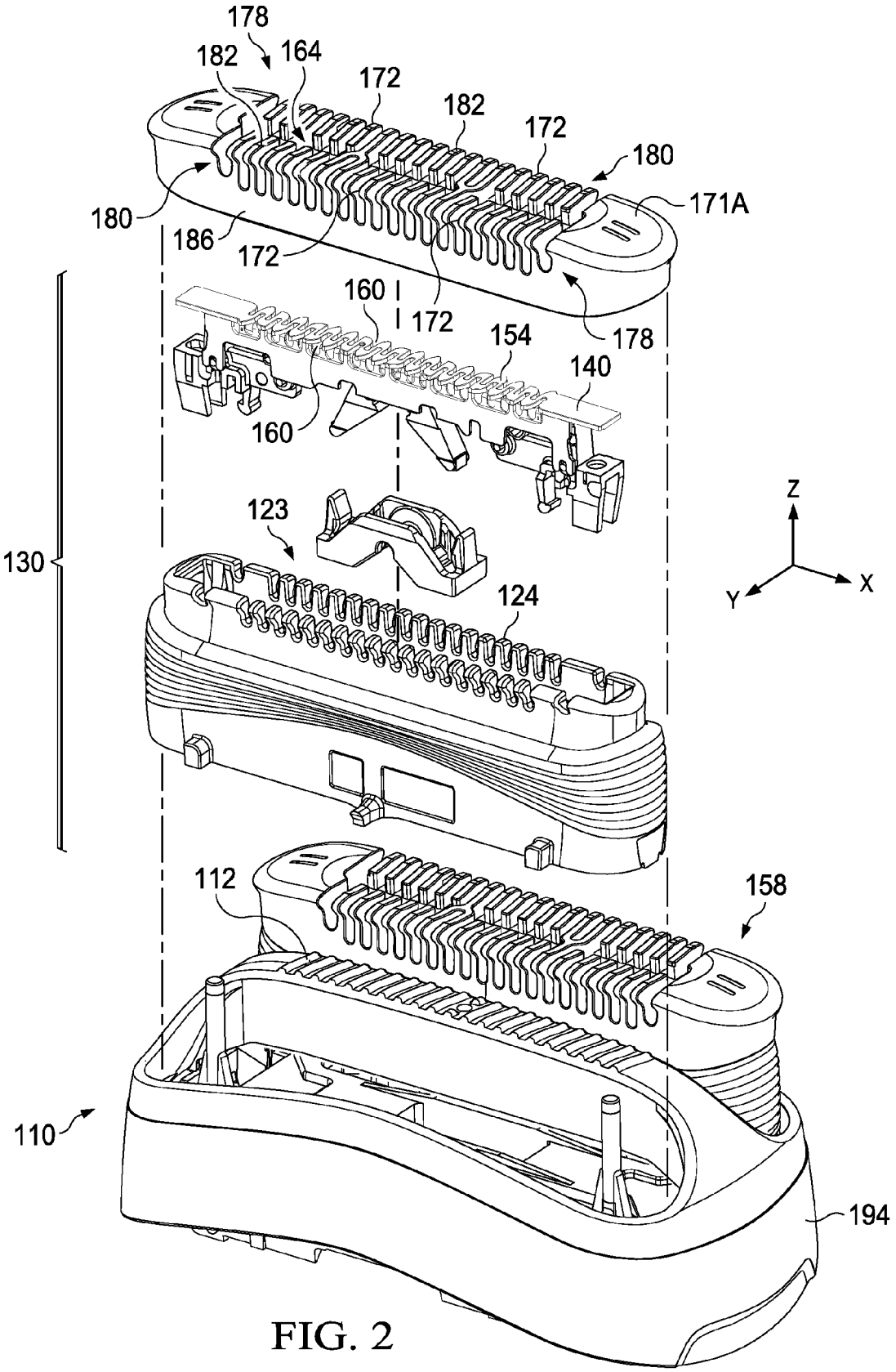
FIG. 2 is an exploded view of the head portion of the beard trimmer shown in FIG. 1.
Figure 3:
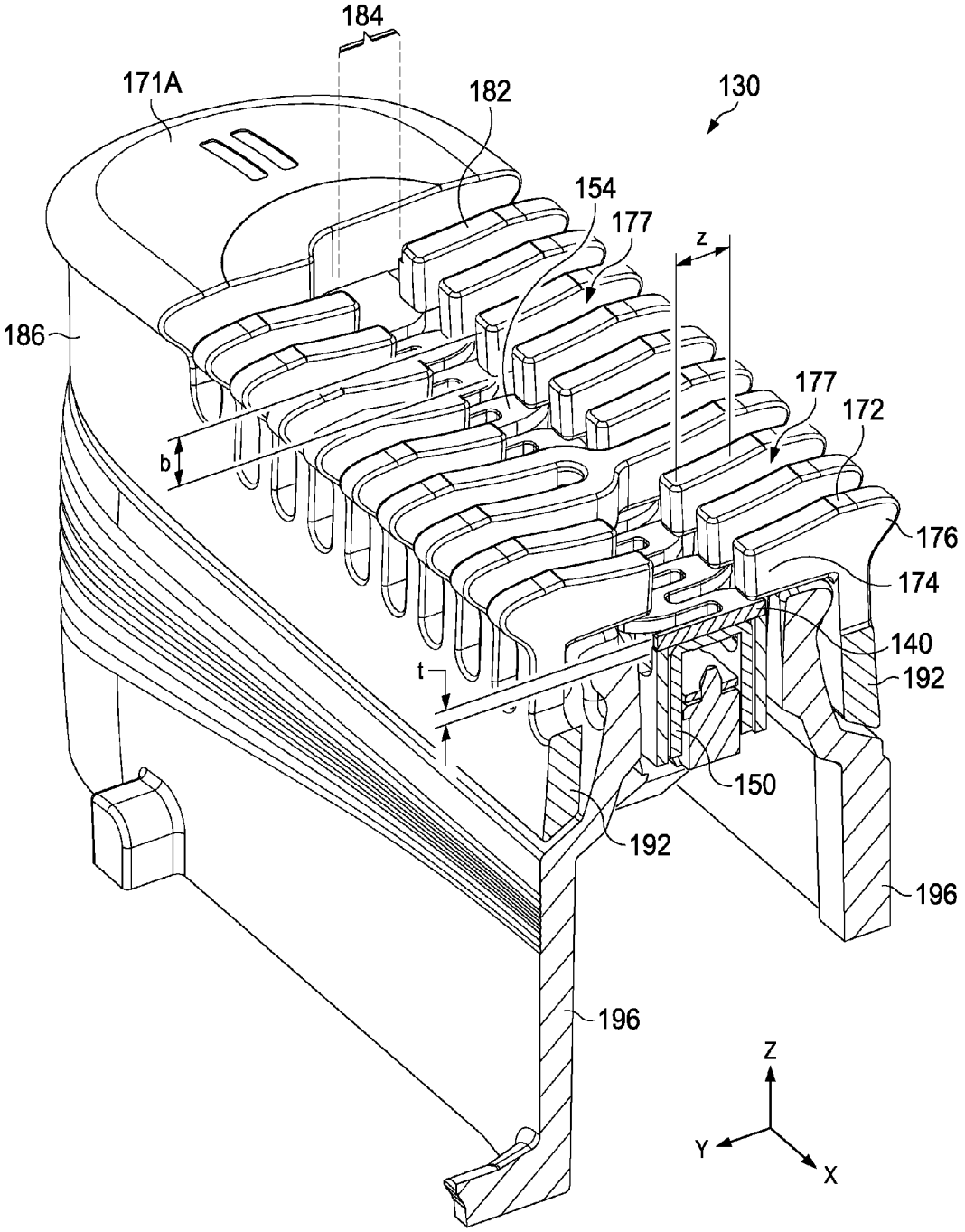
FIG. 3 is a cross-sectional view of a long hair cutting unit with an attached comb unit.

FIG. 2 is an exploded view of the head portion 110 shown in FIG. 1 and FIG. 3 is a cross-sectional view of the first long hair cutter unit 130, shown with an attached first comb unit 171A. Referring to FIGS. 1-3, the first long hair cutter unit 130 can be provided with a first outer cutter 140 and a first inner cutter 150 (FIG. 3). The first outer cutter 140 can be a non-foil type cutter, with the motor 106 configured to drive the first inner cutter 150 to oscillate the first inner cutter 150 relative to the first outer cutter 140 in a direction along an x axis such that hair between the first inner cutter 150 and the first outer cutter 140 is cut. The first outer cutter 140 has a cutter skin contact surface 154 and multiple cutting slots 160 (FIG. 2), which are positioned both side by side and on the opposite sides of the first outer cutter 140. The first outer cutter 140 faces the first inner cutter 150 with its first inner cutting side (not shown). The first inner cutter 150 is provided with cutting edges adapted to cut hair in both opposite movement directions along the y axis.

The first comb unit 171A is selectably attachable to the first long hair cutter unit 130 to change the hair cutting length of the beard trimmer 102. The first comb unit 171A comprises comb elements 178 which, when the first comb unit 171A is attached to the first long hair cutter unit 130, are located adjacent to the multiple cutting slots 160 of the first outer cutter 140. As illustrated, the first comb unit 171A has multiple comb elements 178. Accordingly, when the first comb unit 171A is attached to the first long hair cutter unit 130, the comb elements 178 are positioned on each of the opposite sides of the first outer cutter 140. Each comb element 178 has a row 180 of comb teeth 172, with adjacent comb teeth 172 being separated by comb slots 177. The width of one of the comb slots 177 is in the x axis for the first comb unit 171A and is in the range of 0.3 mm to 2.2. mm, for example. The comb teeth 172 may have any suitable cross-sectional shape, such as a T-shaped cross-sectional shape (as shown in FIG. 3) or an L-shaped cross-sectional shape, among others. Each of the comb teeth 172 has a tooth skin contact surface 182 which is located on an elevated upper level relative to the cutter skin contact surface 154. The tooth skin contact surface 182 engages with the user's skin during use of the beard trimmer 102 and prevents the cutter skin contact surface 154 from being brought into skin contact. A distance between the tooth skin contact surface 182 of the comb unit 171A and the first inner cutting side of the first outer cutter 140 defines the hair trimming length. An inner surface of the first comb unit 171A faces the cutter skin contact surface 154 and is opposite to the tooth skin contact surface 182. The inner surface of the first comb unit 171A may be spaced from the cutter skin contact surface 154 by a distance of less than 0.6 mm, or preferably less than 0.4 mm, or more preferably less than 0.3 mm.

Further, as shown in FIG. 3, the comb elements 178 on opposite sides of the first comb unit 171A are separated from one another in the y axis by a hair cutting gap 184 (also shown in FIG. 9C) to allow for a skin wave to enter the gap during use. As such, the hair cutting gap 184 may assist with feeding hair into the first long hair cutter unit 130. The hair cutting gap 184 may be smaller than a width of the first outer cutter 140. Therefore, at least a portion of the comb teeth 172 may partly overlap and cover the cutter skin contact surface 154 of the first outer cutter 140. The width of the hair cutting gap 184 may range from 1.5 mm to 7 mm. In some configurations, the width of the hair cutting gap 184 corresponds to the width of the first outer cutter 140. The width of the hair cutting gap may also vary between comb sets. For instance, the hair cutting gap of the comb set 170 may be wider than the hair cutting gap of the comb set 171. Additional detail is provided below with regard to example hair cutting caps in FIGS. 8A-11B. The comb teeth 172 may each have an inward tip portion 174 which is directly adjacent to the hair cutting gap 184 and an outward tip portion 176 on each outwardly opposite side of each tooth. The thickness of the inward tip portion 174 in a z-direction towards the handle 104, which is orthogonal to axis x, may be smaller than the thickness of the outward tip portion 176 in the z-direction. In some configuration, the thickness of the inward tip portion 174 in the z-direction is the smallest thickness of each of the comb teeth 172. As shown in FIG. 3, the tooth skin contact surface 182 may comprise an indentation towards the hair cutting gap 184 relative to a planar plane over the outermost portions of the comb teeth 172. Such an indentation may assist with directing hair into the first outer cutter 140 so that it can be trimmed. Further, in some configuration, each comb tooth 172 of each comb element 178 is aligned with a comb slot 177 of the comb element 178 on the opposite side of the first comb unit 171A, which may also aid with directing hair into the first outer cutter 140.

The opposing comb elements 178 of the first comb unit 171A may have certain teeth that are connected to one another, with such connection traversing the hair cutting gap 184. In some embodiments, one to five comb teeth of a row of comb teeth 172 on one side of the first comb unit 171A are connected with one to five comb teeth of the other row of comb teeth 172 on the opposite side of the first comb unit 171A. Such connection may aid in structural rigidity of the first comb unit 171A. All of the comb teeth 172 are coupled to an elongate circular wall 186.

The first comb unit 171A may have about the same number of comb teeth 172 on both lateral sides. Further, the cross sectional shape of the comb teeth 172 may be the same on both lateral sides of the first comb unit 171A. In some configurations, the first comb unit 171A has more than 15 comb teeth 172 on each lateral side thereof. Thus, the first long hair cutter unit 130 may have around the same number of cutting slots on both lateral sides. Accordingly, the first long hair cutter unit 130 may be substantially symmetrical with respect to both lateral sides so that said beard trimmer 102 is designed to be equally efficient in both opposite movement directions of the beard trimmer 102, with or without first comb unit 171A. Thus the first comb unit 171A may comprise comb teeth 172 on both lateral sides which are symmetrical and/or the same with respect to the tooth shape and its thickness along z axis and x axis, so that the first comb unit 171A is usable in both opposite movement directions along the y axis with the same hair catching result and/or hair combing result and/or hair trimming result. It is noted that the z axis is shown to extend from the motor shaft 108 (see FIG. 7) vertically through the cutter skin contact surface 154 and parallel to a motor axis. In other configurations, however, the motor axis may be inclined relative to the z axis. For instance, beard trimmers in accordance with the present disclosure may have a cranked head configuration in which the head portion is angled relative to the motor axis.

The comb teeth 172 of the first comb unit 171A may be more flexible when the first comb unit 171A is detached from the first long hair cutter unit 130 relative to the flexibility of the comb teeth 172 when the first comb unit 171A is attached to the first long hair cutter unit 130. The rigidity of the comb teeth 172 when the first comb unit 171A is attached to the first long hair cutter unit 130 allows for limited or no variance in cutting length when the beard trimmer is used, such that the cutting length uniformity is substantially or completely independent of pressure. Such rigidity of the comb teeth 172 is due, at least in part, to the comb teeth 172 being well-supported in the vertical direction (i.e., the z axis) when the first comb unit 171A is attached to the first long hair cutter unit 130. As shown in the configuration illustrated in FIG. 2, each comb tooth 172 is supported by a corresponding tooth of a second long hair comb unit 124, which is described in more detail below. The enveloping of the first long hair cutter unit 130 by the elongate circular wall 186 when the first long hair cutter unit 130 also serves to add desired rigidity to the system. The first comb unit 171A may be adapted to allow for an amount of flexing of the comb teeth 172 in a comb teeth zone (shown as zone z in FIG. 3) which is located closest to the first outer cutter 140 of less than 0.6 mm, preferably less than 0.4 mm and more preferably less than 0.3 mm. Furthermore, the first comb unit 171A may be made of a suitable thermoplastic material, such as Polyoxymethylene, having an Elastic Modulus ranging between 1850 MPa and 3850 MPa or more preferably said Elastic Modulus is ranging between 2350 MPa and 3350 MPa.

The first long hair cutter unit 130 may be provided with a lateral housing 196 which is also made of a thermoplastic material. The first comb unit 171A may be selectably coupled to the first long hair cutter unit 130 through any suitable type of connection, such as a snap fit connection. A snap fit connection serves to connect the lateral housing 196 with the first comb unit 171A. Further, the inner side of first comb unit 171A, which faces towards said first long hair cutter unit 130, may be tub shaped to define a cavity that is configured to receive at least a portion of the first long hair cutter unit 130. An opening is provided within the first comb unit 171A by means of a slot shaped center area 164. The lateral housing 196 may have features, such as a shoulder, groove, or other feature that is configured to engage with a protrusion or other projection of the first comb unit 171A to maintain the relative position of the first comb unit 171A to the first long hair cutter unit 130 once the first comb unit 171A is connected to the lateral housing 196. The first comb unit 171A may be snap fit connectable with the lateral housing 196 in a first position and in a second position, where the first comb unit 171A is rotated by 180 degree around the z axis in the second position relative to the first position.

The beard trimmer 102 may have a second comb unit 124 (FIG. 2) that is provided adjacent to the first outer cutter 140. The second comb unit 124 is non-detachable and may have a row of teeth 123 positioned on both lateral sides of first long hair cutter unit 130. As illustrated, these comb teeth may be directed towards both opposite movement directions along the y axis. The second comb unit 124 may be covered by the detachable first comb unit 171A. When the beard trimmer 102 is used without the first comb unit 171A, or other selectably attachable comb unit, the second non-detachable comb unit 124 may assist with directing hair into the first outer cutter 140. In some configurations, the second comb unit 124 aids in enlarging the contact surface between the skin and outer cutter 140 in order to increase comfort during the shaving process. Using the beard trimmer 102 without an attached comb unit (i.e., only using the second comb unit 124) may also be particularly comfortable to user's prone to certain types of skin irritations, such as pseudofolliculitis barbae (PFB).

As shown in FIG. 1, the head portion 110 of the beard trimmer 102 may have a second long hair cutter unit 158. The second long hair cutter unit 158 is configured similarly as the first long hair cutter unit 130 and is selectably covered by a third comb unit 171B. The third comb unit 171B is dimensionally sized similarly as the first comb unit 171A and is independently detachably mounted to the second long hair cutter unit 158. As described in more detail below with regard to FIGS. 4-6, the first long hair cutter unit 130 and the second long hair cutter unit 158 may be independently movable. When the first comb unit 171A and the third comb unit 171B are connected to the first long hair cutter unit 130 and the second long hair cutter unit 158, respectively, they are separated by a comb unit gap 179 (FIG. 4) in the y axis direction. The comb unit gap 179 is defined by the free ends of the comb teeth 172 of the first comb unit 171A which face the free ends of the third comb unit 171B and its width may be in the range of 2 mm to 6 mm. The first comb unit 171A may have two rows of comb teeth 172 and comb slots. Each tooth of the first comb unit 171A may comprise two free ends along the tooth skin contact surface 182. Accordingly, the first comb unit 171A may have along the two rows of comb teeth 172 and along its tooth skin contact surfaces 182 two rows of outwardly pointing free ends and two rows of inwardly pointing free ends.

In some configurations, the beard trimmer 102 comprises a functional non-shaving and non-trimming element 112 (FIG. 2) that is adapted for skin and/or hair treatment. The functional non-shaving and non-trimming element 112 may be disposed, for example, between the first long hair cutter unit 130 and second long hair cutter unit 158 within the comb unit gap 179 and be adapted to, for instance, cool or heat up the skin or to comb the hair or to apply a cosmetic substance.

Figure 4:
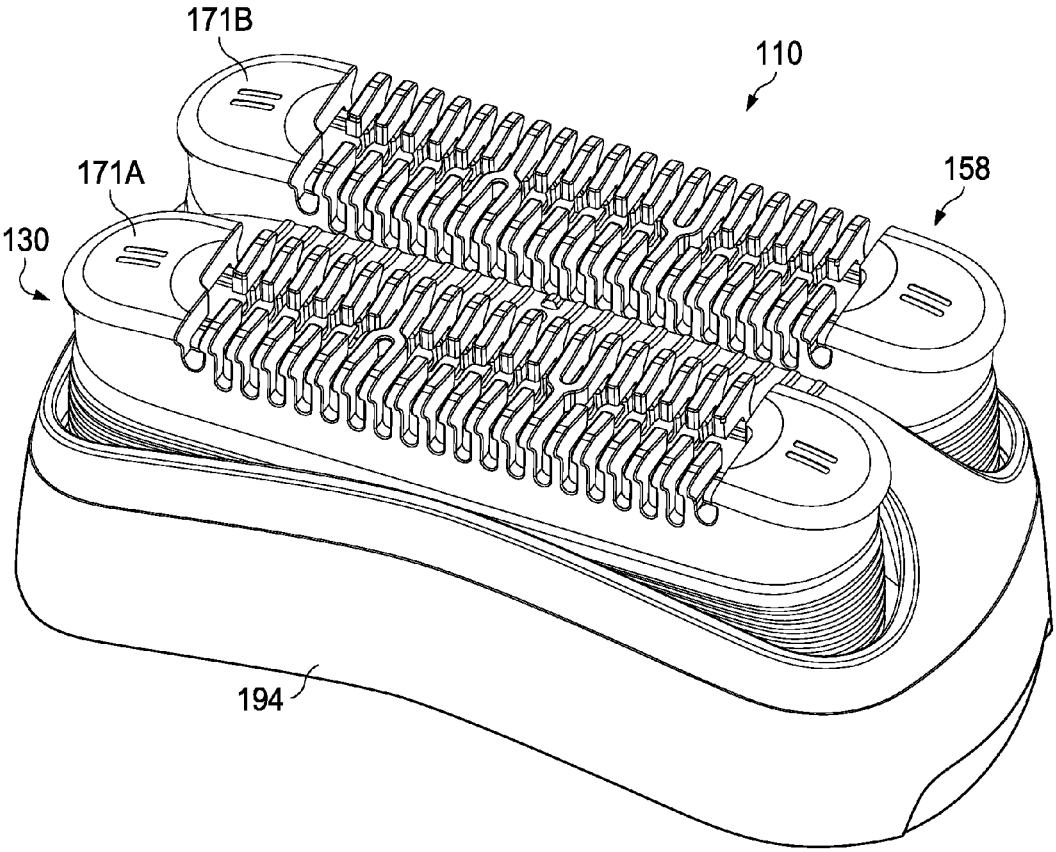
FIG. 4 is a perspective view and side view of the head portion of FIG. 1, with long hair cutting units shown in a first position.
Figure 4:
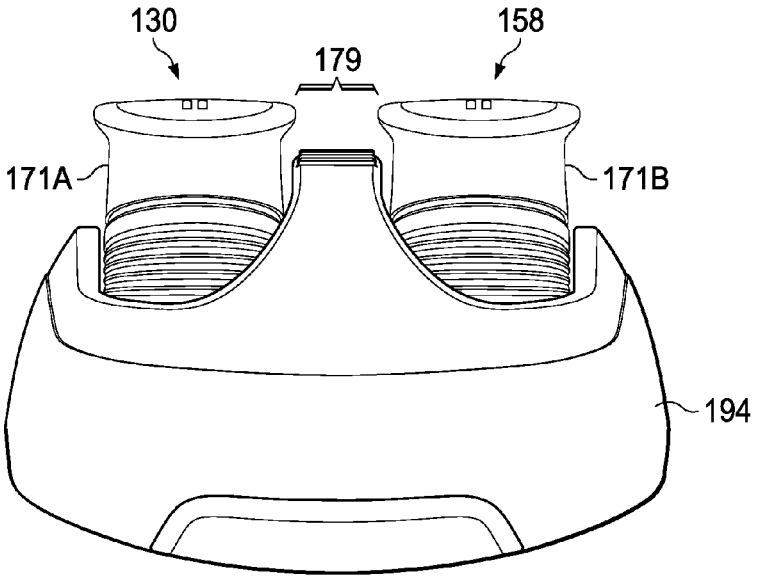
Figure 5:
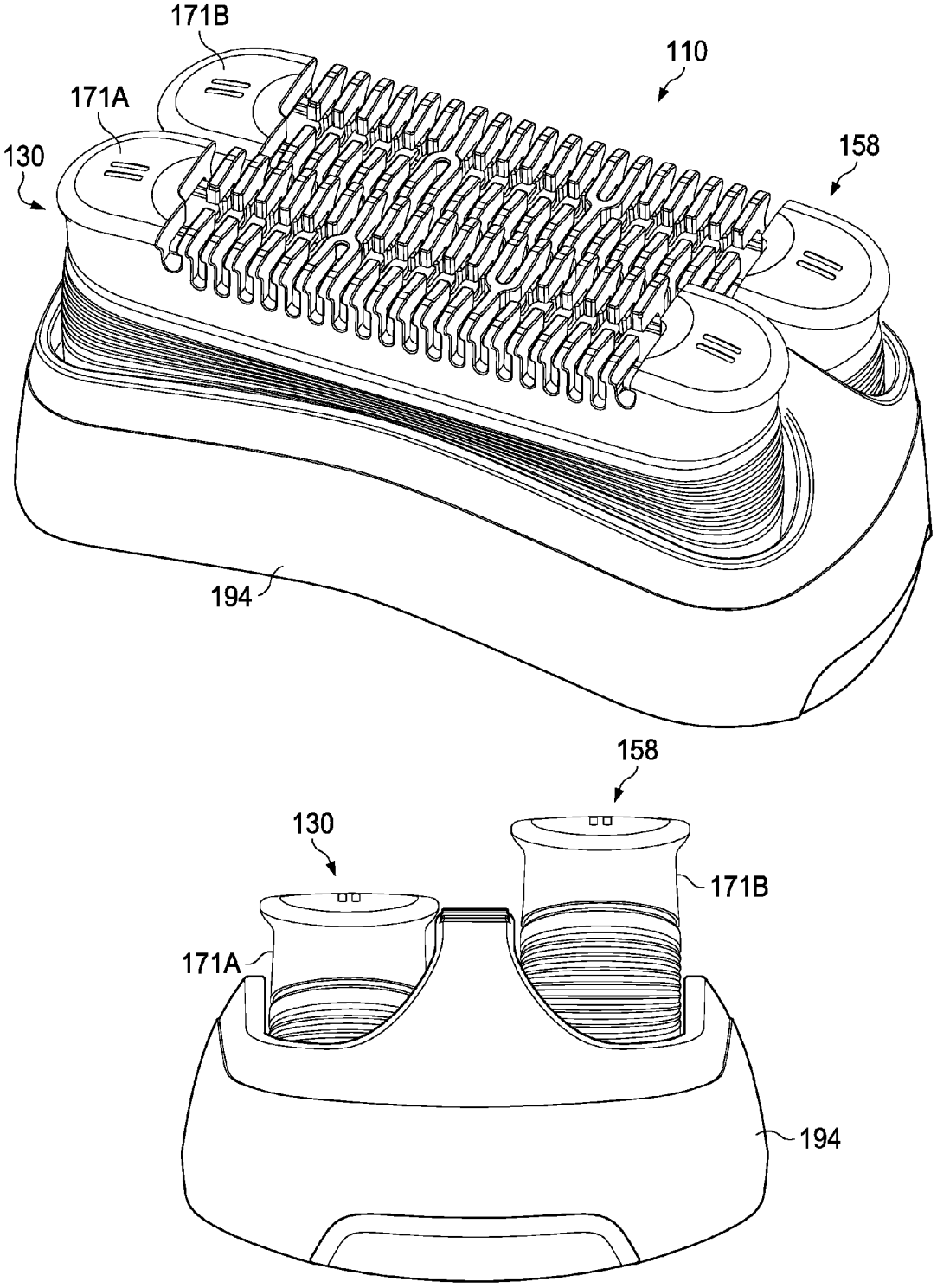
FIG. 5 is a perspective view and side view of the head portion of FIG. 1, with long hair cutting units shown in a second position.
Figure 6:
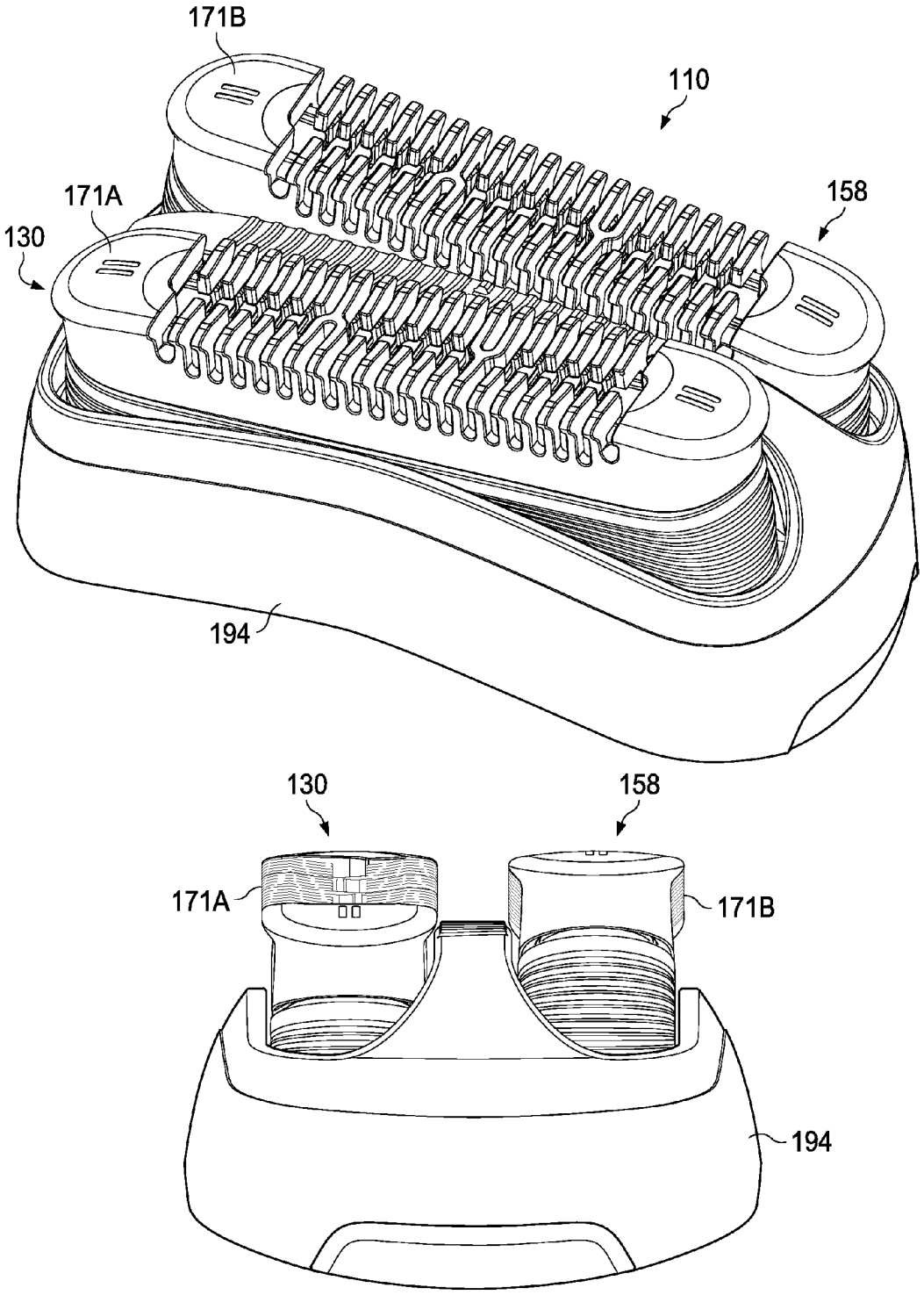
FIG. 6 is a perspective view and side view of the head portion of FIG. 1, with long hair cutting units shown in a third position.

Referring to FIGS. 4-6, perspective views and corresponding end views of the head portion 110 of the beard trimmer 102 are depicted with the first and second long hair cutting units 130, 158 in first, second, and third positions, respectively. As shown, each of the first long hair cutter unit 130 and the second long hair cutting unit 158 are independently moveable with respect to the outer housing part 194. Such movability of the first long hair cutter unit 130 and the second long hair cutting unit 158 during the shaving process can provide for better efficiency, improved contour following, and increased uniformity in cutting length. Further, the first comb unit 171A detachably mounted to the first long hair cutter unit 130 are movable together, as is the third comb unit 171B detachably mounted to the second long hair cutting unit 158. As shown in FIG. 5, each of the first long hair cutter unit 130 and the second long hair cutting unit 158 are shown to float as they are each independently moveable along the z axis. The first long hair cutter unit 130 and the first comb unit 171A are shown at least partially retracted into the outer housing part 194. The second long hair cutter unit 158 and the third comb unit 171B are shown at least partially extending out of the outer housing part 194. As shown in FIG. 6, each of the first long hair cutter unit 130 and the second long hair cutting unit 158 may independently tilt (i.e., pivot about an axis orthogonal to a longitudinal axis of the long hair cutter unit) relative to the outer housing part 194. The first long hair cutter unit 130 and the first comb unit 171A are shown tilting in a counter clockwise direction and the second long hair cutter unit 158 and the third comb unit 171B are shown tilting in a clockwise direction. The first long hair cutter unit 130 and the second long hair cutting unit 158 can also collectively swivel (i.e., pivot about an axis parallel to a longitudinal axis of the long hair cutter unit). The floating, tilting, and/or swiveling of the first long hair cutter unit 130 and the floating, tilting, and/or swiveling of the second long hair cutting unit 158 can provide for increased contour following allowing the user to achieve desired results without necessarily requiring repositioning and/or regripping of the beard trimmer 102 by the user.

Figure 7:
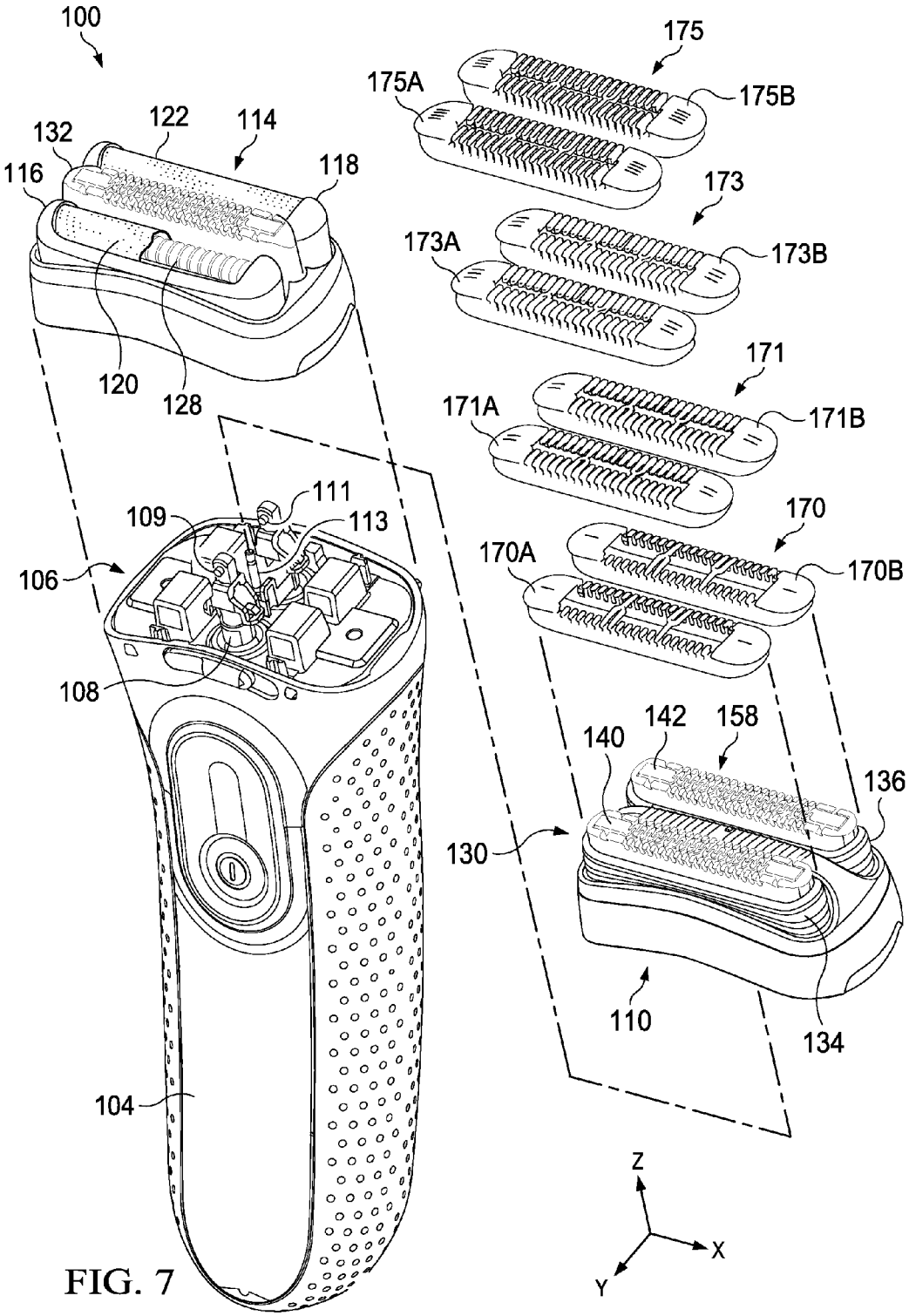
FIG. 7 is a front perspective view of an electric hair cutting kit having a removable head portion, a shaver head portion, and a plurality of comb units in accordance with one embodiment.

FIG. 7 is a front perspective view of an electric hair cutting kit 100. The electric hair cutting kit 100 includes the removable head portion 110 and a shaver head portion 114, each of which are selectively attachable to the handle 104. The shaver head portion 114 may be attached to the handle 104 when the user is seeking a closer shave than is provided by the first long hair cutter unit 130 and the second long hair cutting unit 158 of the removable head portion 110. The shaver head portion 114 has at least a first shaver unit 116, which is provided with a first foil-type outer shaver cutter 120 and a first inner shaver cutter 128. When the shaver head portion 114 is attached to the handle 104, the motor 106 drives the first inner shaver cutter 128 in order to oscillate relative to the first foil-type outer shaver cutter 120 in a direction along x axis to cut hair between the first inner shaver cutter 128 and the first foil-type outer shaver cutter 120. The motor 106 has a motor shaft 108 connected with at least the first drive pin 109 for driving either the first shaver unit 116 or the first long hair cutter unit 130, depending on which unit is attached to the handle 104. The first drive pin 109 may be provided with an adapter that fits both with the first shaver unit 116 and the first long hair cutter unit 130.

The shaver head portion 114 may also be provided with a second shaver unit 118 which is of the same type as the first shaver unit 116 having a second foil-type outer shaver cutter 122. Further, the shaver head portion 114 may be provided with a third long hair cutter unit 132. The third long hair cutter unit 132 may be substantially similar to each of the first and second long hair cutter units 130, 158 having a non-foil type outer cutter 142 and an inner cutter. In the illustrated configuration, the third long hair cutter unit 132 is positioned between the first shaver unit 116 and the second shaver unit 118. The third long hair cutter unit 132 operates simultaneously as the first and second shaver units 116, 118. The motor shaft 108 may also be connected with a second drive pin 111 for driving either the second shaver unit 118 or the second long hair cutter unit 158 and/or the motor shaft 108 is connected with a third drive pin 113 for driving the third long hair cutter unit 132. The shaver head portion 114 and/or the removable head portion 110 may further be provided with a functional non-shaving and non-trimming element 112 (as shown in FIG. 2). The functional non-shaving and non-trimming element 112 may be adapted to, for instance, cool or heat up the skin or to comb the hair or to apply a cosmetic substance.

Also included in the electric hair cutting kit 100 are a plurality of comb sets 170, 171, 173, and 175, with each comb set including comb units to the first and second long hair cutter units 130, 158. While four sets 170, 171, 173, 175 are depicted in FIG. 7, this disclosure is not so limited. For instance, other electric hair cutting kits can have more than four comb sets or less than four comb units. The user can select which of the comb sets to use depending on the cutting length that is desired, as comb set 170 may be sized to maintain a 1-day beard look, while comb set 175 may be sized to maintain a 5-day beard look, based on cutting length.

Figure 8A:
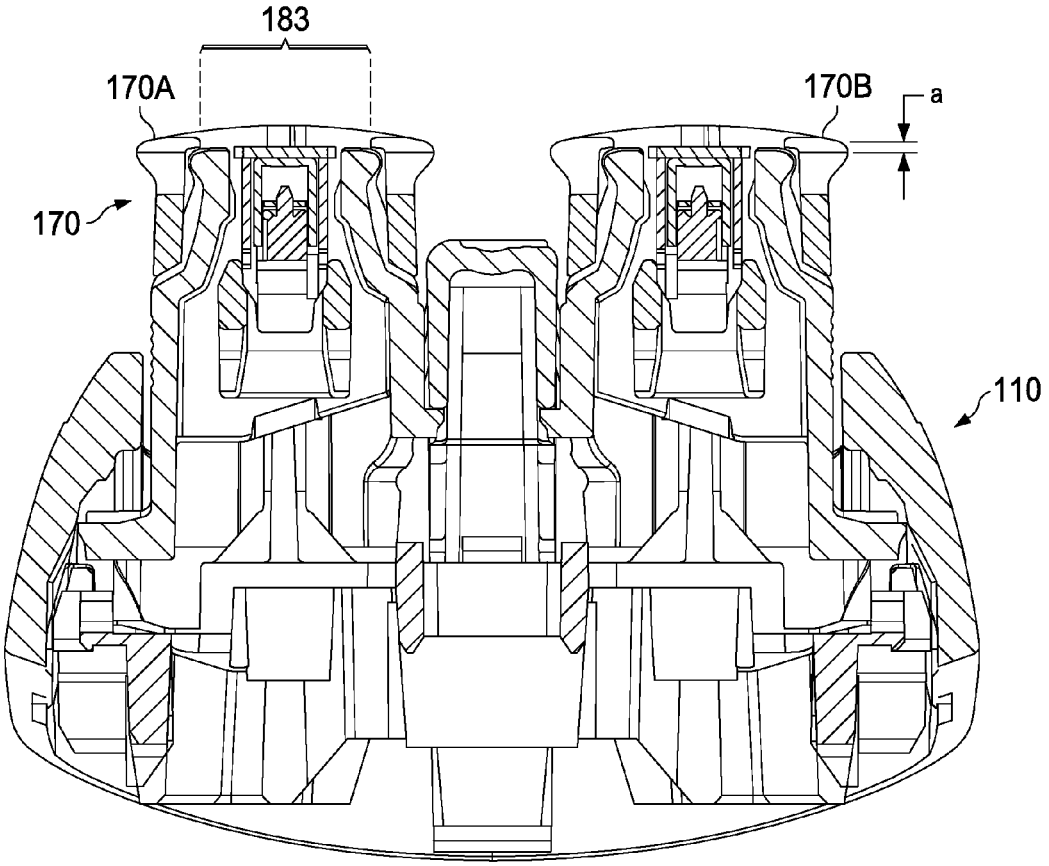
FIG. 8A is a cross-sectional view of a comb set attached to a head portion.
Figure 8B:
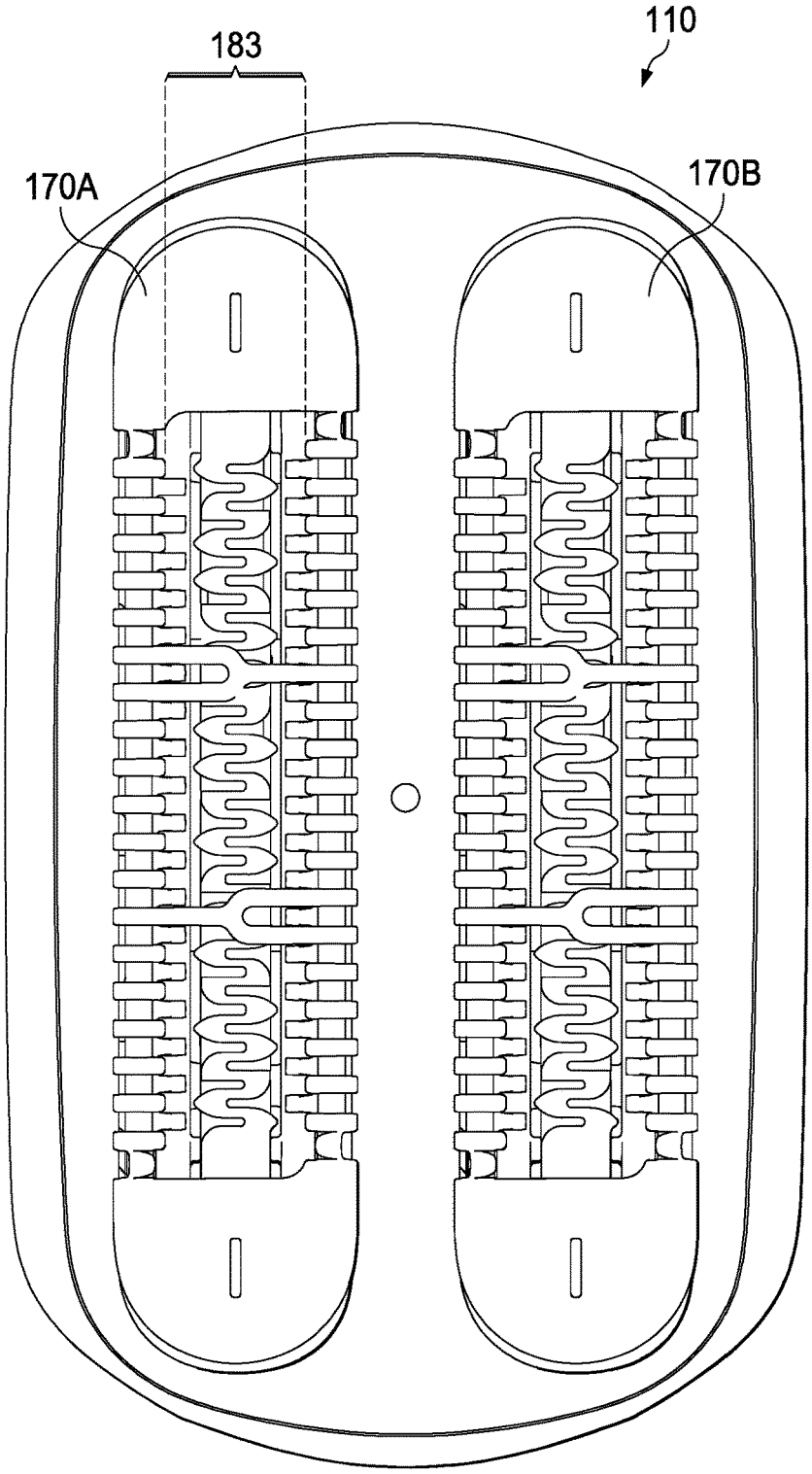
FIG. 8B is a top view of the comb set of FIG. 8A attached to the head portion.

FIGS. 8A-8B depicts the comb units 170A and 170B of the comb set 170 coupled to the removable head portion 110. FIG. 8A shows a cross-sectional view of the head portion 110 with the comb set 170 attached thereto and FIG. 8B is a corresponding top view. As shown in FIG. 3, a thickness of the first outer cutter 140 of the first long hair cutter unit 130 along z axis is shown as thickness (t). The comb unit 170A of the comb set 170 is provided with comb teeth wherein a thinnest section (a) of the comb teeth (shown in FIG. 8A) in a direction along z axis contribute to a comb hair trimming length of the comb set 170, which is substantially the thickness of (a) and (t). Comb unit 170A also has a hair cutting gap 183. Comb unit 170B has a similarly sized hair cutting gap.

Figure 9A:
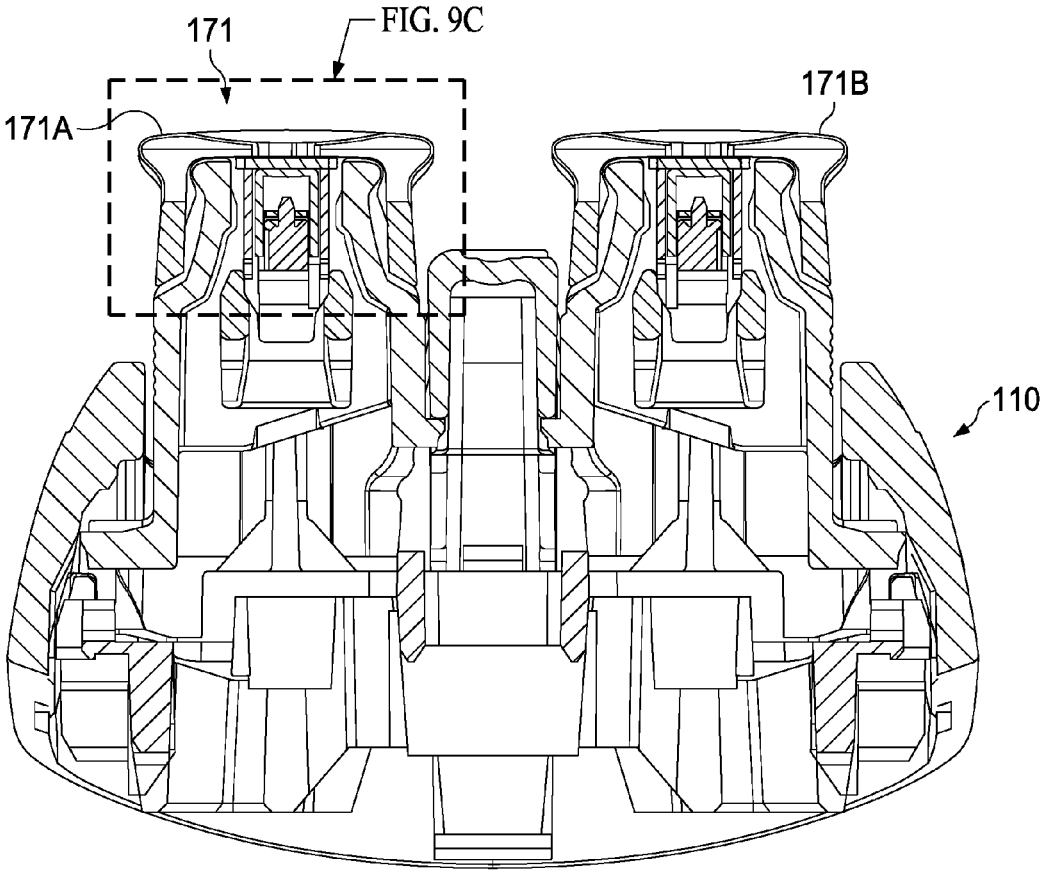
FIG. 9A is a cross-sectional view of a comb set attached to a head portion.
Figure 9B:
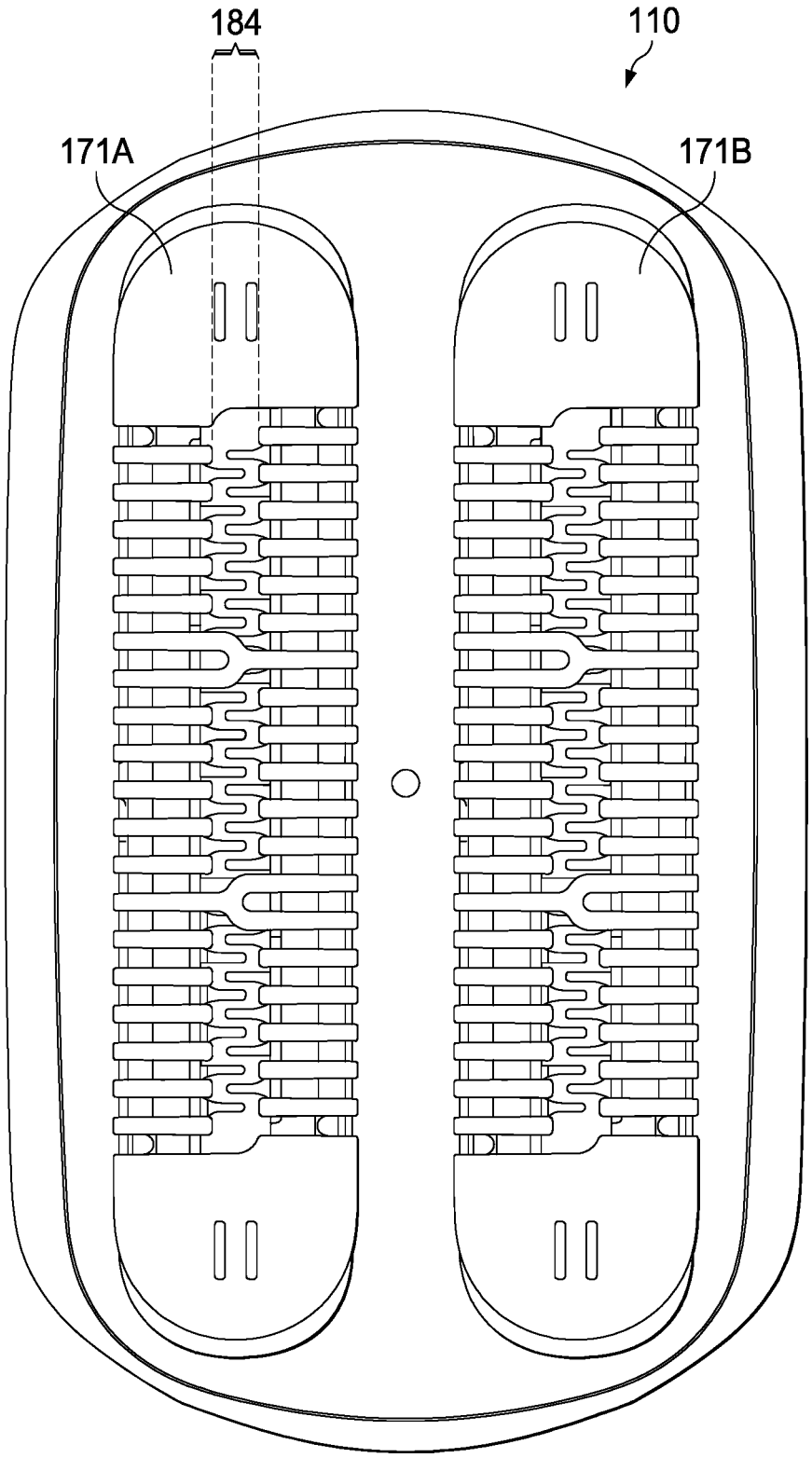
FIG. 9B is a top view of the comb set of FIG. 9A attached to the head portion.
Figure 9C:
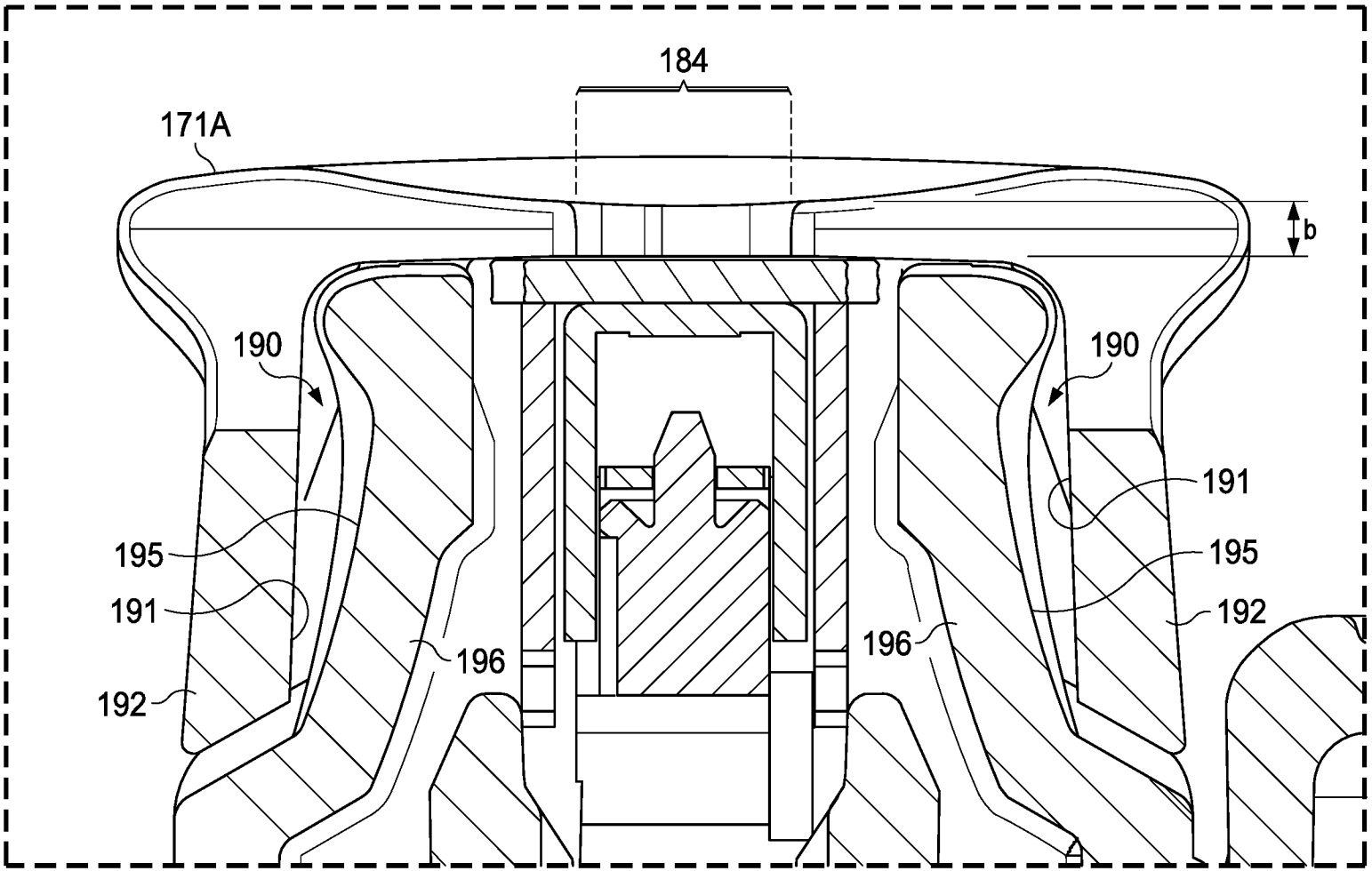
FIG. 9C is an enlarged section of FIG. 9A.

FIGS. 9A-9B depicts the comb units 171A and 171B of the comb set 171 coupled to the removable head portion 110. FIG. 9A shows a cross-sectional view of the head portion 110 with the comb set 171 attached thereto and FIG. 9B is a corresponding top view. FIG. 9C depicts an enlarged section of FIG. 9A. Comb unit 171A has a hair cutting gap 184, as discussed above in association with FIG. 3. The hair cutting gap 184 may be slightly narrower than the hair cutting gap 183 shown in FIGS. 8A-8B. The comb unit 171A of the comb set 171 is provided with comb teeth wherein a thinnest section (b) of the comb teeth (shown in FIG. 9C) in a direction along z axis contribute to a comb hair trimming length of the comb set 171, which is substantially the thickness of (b) and (t) (thickness (t) is shown in FIG. 3). The thinnest section (b) may be slightly greater than the thinnest section (a) depicted in FIGS. 8A-8B.

Referring to FIG. 9C, which depicts an enlarged section of the head portion 110, a box 190 may be formed for catching, collecting, or otherwise storing cut hair. The box 190 may be at least partially formed by the inner surface 191 of the side walls 192 of the first comb unit 171A. In some configurations, the elongate circular wall 186 (FIG. 3) encapsulates both lateral sides of the first long hair cutter unit 130 (FIG. 3) and forms the side walls 192. An outer surface 195 of the lateral housing 196 of the first long hair cutter unit may also form part of the box 190. In some configurations, the volume of the box 190 may be more than 0.6 cubic centimeters. In some configurations, the volume of the box 190 may be more than 0.8 cubic centimeters. The box 190 may be emptied by, for instance, removing the head portion 110 from the handle 104, removing the first long hair cutter unit 130 from the head portion 110, and/or removing the first comb unit 171A from the first long hair cutter unit 130.

Figure 10A:
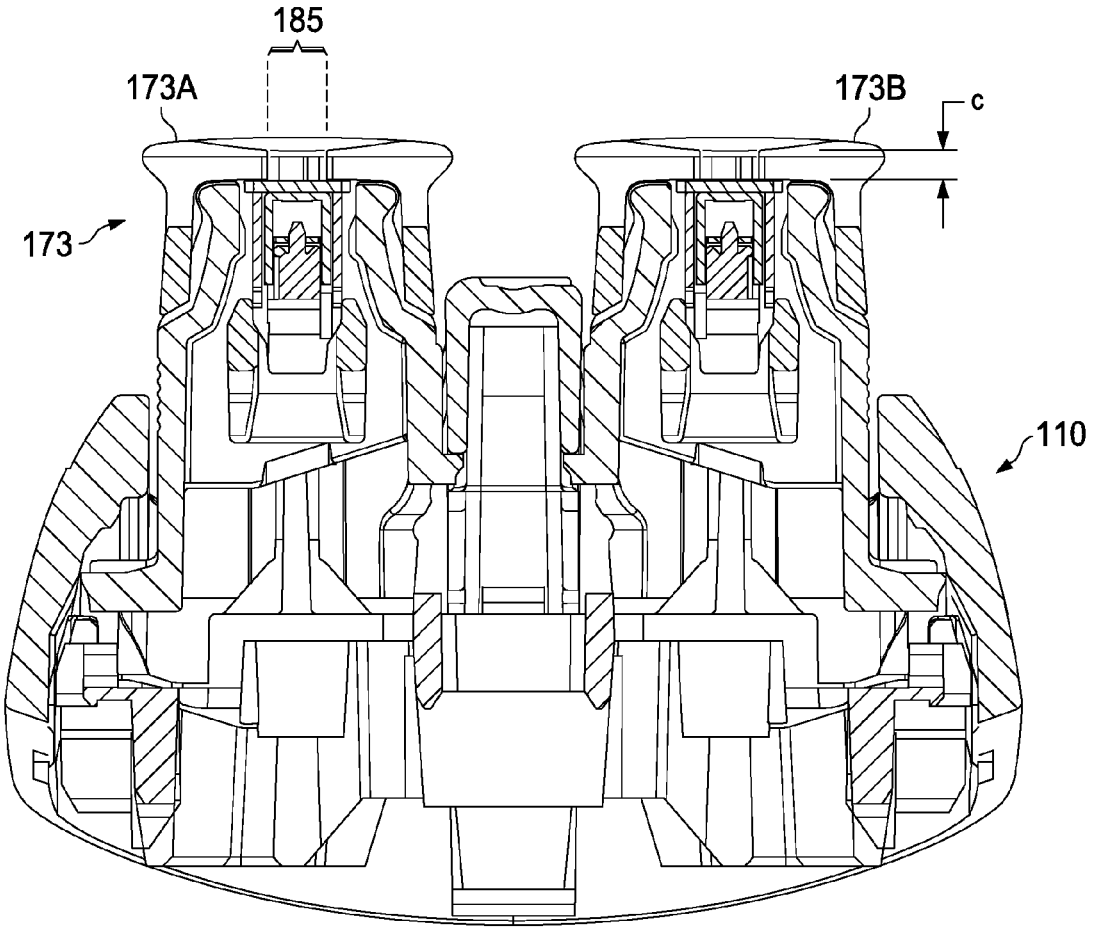
FIG. 10A is a cross-sectional view of a comb set attached to a head portion.
Figure 10B:
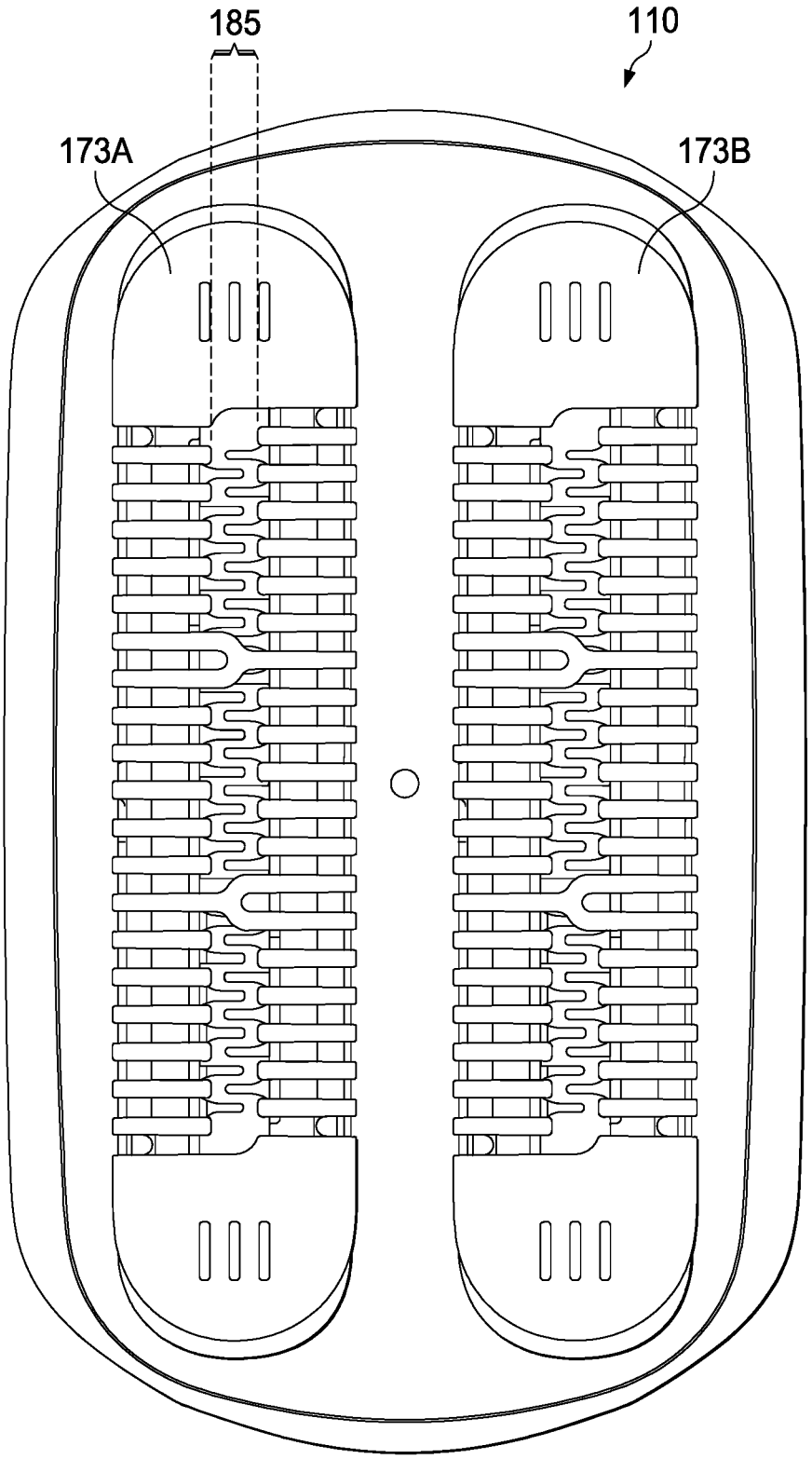
FIG. 10B is a top view of the comb set of FIG. 10A attached to the head portion.

FIGS. 10A-10B depicts the comb units 173A and 173B of the comb set 173 coupled to the removable head portion 110. FIG. 10A shows a cross-sectional view of the head portion 110 with the comb set 173 attached thereto and FIG. 10B is a corresponding top view. Comb unit 173A has a hair cutting gap 185. The hair cutting gap 184 may be slightly narrower than the hair cutting gap 184 shown in FIGS. 9A-9C. The comb unit 173A of the comb set 173 is provided with comb teeth wherein a thinnest section (c) of the comb teeth (shown in FIG. 10A) in a direction along z axis contribute to a comb hair trimming length of the comb set 173, which is substantially the thickness of (c) and (t) (thickness (t) is shown in FIG. 3). The thinnest section (c) may be slightly greater than the thinnest section (b) depicted in FIGS. 9C.

Figure 11A:
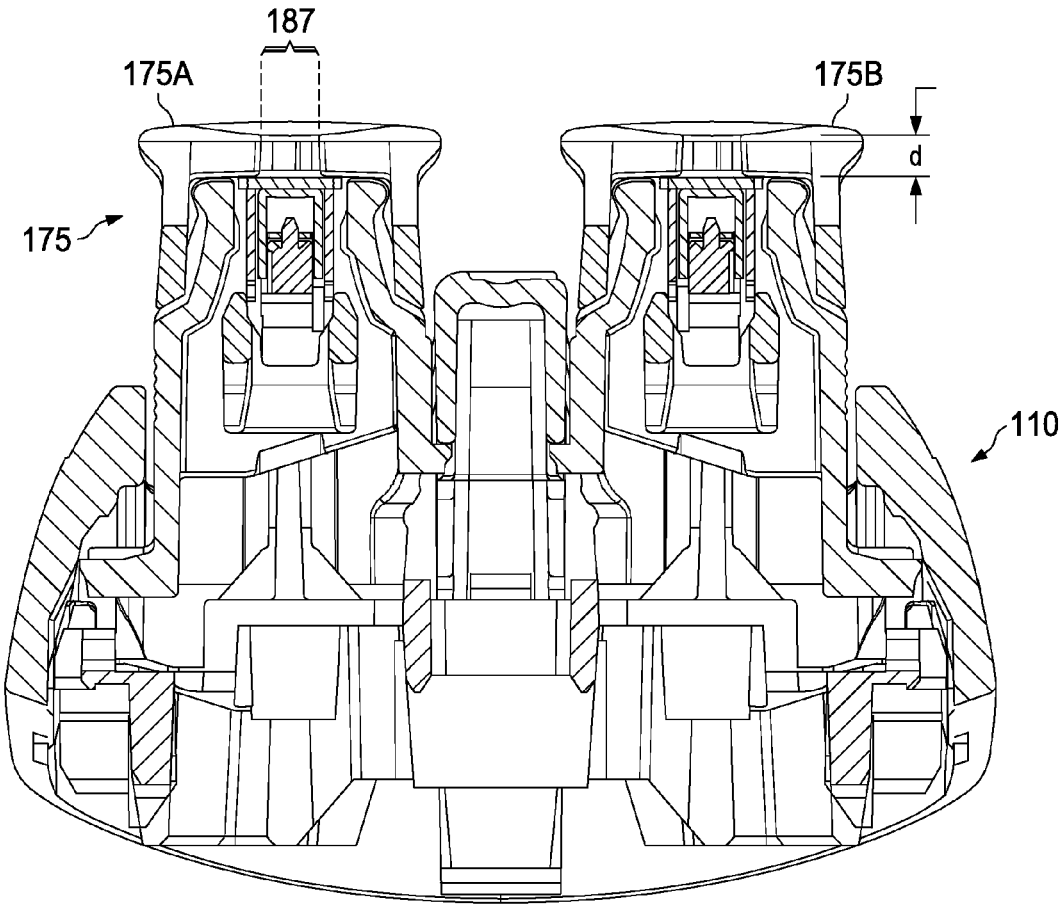
FIG. 11A is a cross-sectional view of a comb set attached to a head portion.
Figure 11B:
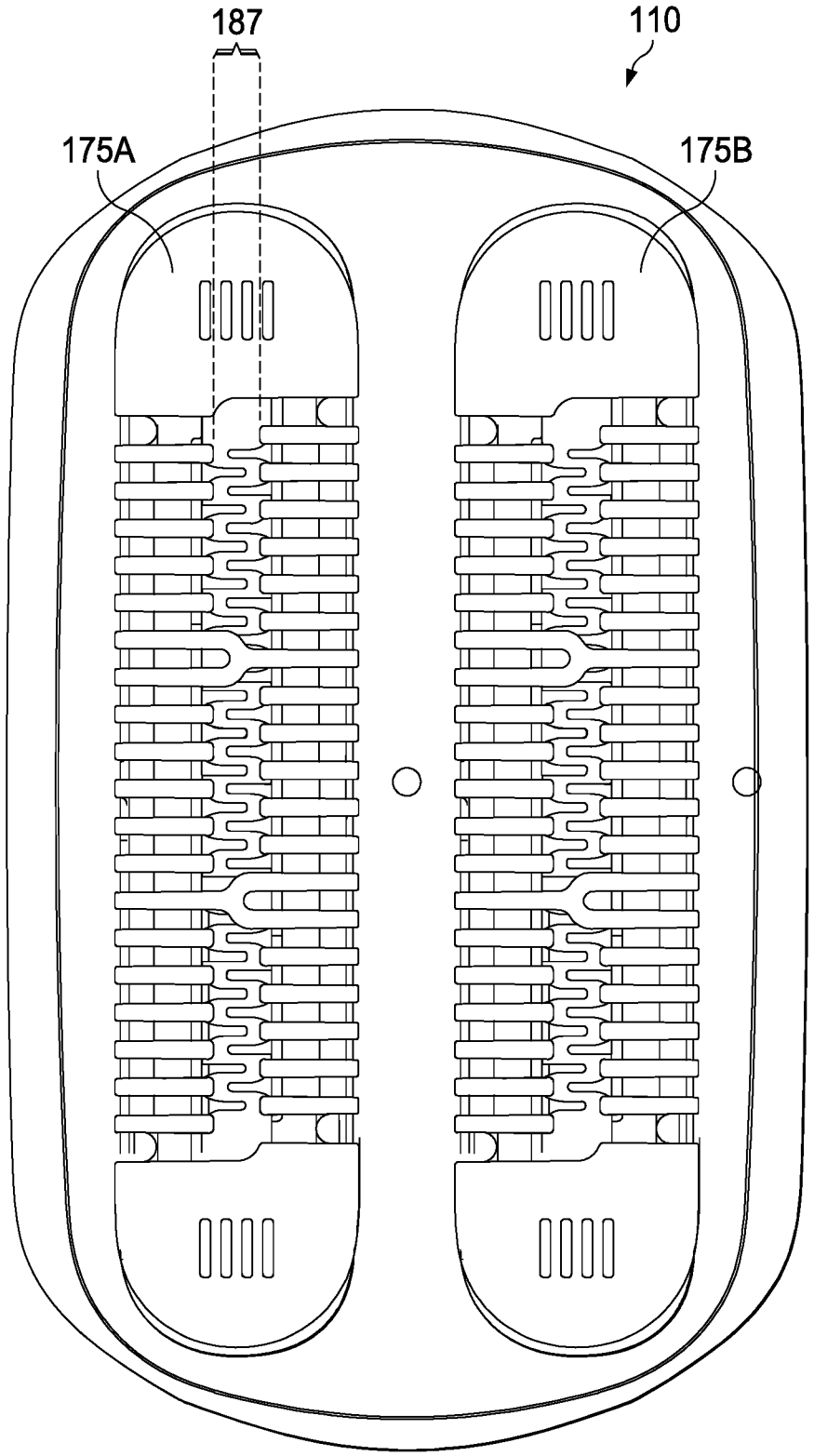
FIG. 11B is a top view of the comb set of FIG. 11A attached to the head portion.

FIGS. 11A-11B depicts the comb units 175A and 175B of the comb set 175 coupled to the removable head portion 110. FIG. 11A shows a cross-sectional view of the head portion 110 with the comb set 175 attached thereto and FIG. 10B is a corresponding top view. Comb unit 175A has a hair cutting gap 187. The hair cutting gap 187 may be slightly narrower than the hair cutting gap 185 shown in FIGS. 10A-10B. The comb unit 175A of the comb set 175 is provided with comb teeth wherein a thinnest section (d) of the comb teeth (shown in FIG. 11A) in a direction along z axis contribute to a comb hair trimming length of the comb set 175, which is substantially the thickness of (d) and (t) (thickness (t) is shown in FIG. 3). The thinnest section (d) may be slightly greater than the thinnest section (c) depicted in FIGS. 10A.

As shown in FIGS. 8A-11B, since each of the comb sets 170, 171, 173, 175 have a different tooth thicknesses, shown as (a), (b), (c), and (d), respectively, the user is provided with a variety of hair trimming options based on which comb set (if any) is attached to the head portion. Furthermore, as is shown in FIGS. 8A-11B, as the tooth thickness increases, the width of the hair cutting gap can narrow. The comb set 170 has relatively thin teeth and a relatively wide hair gap 183, while comb set 175 has relatively thick teeth and a relative narrow hair gap 187. As such, the hair gap is dimensioned to allow a certain sized skin wave to enter the gap during use according to desired trim length. Skin can easily enter the hair gap 183 of the comb set 170 due to its relatively wide width and the hair can be cut close enough so that a 1-day homogeneous beard/stubble is achieved. Comparatively, comb set 175 is configured to create the greatest distance to the outer cutter due to the increased tooth thickness. The hair gap 187 is also much narrower than that of the comb set 170 which reduces the skin wave that can enter the gap. As shown in FIGS. 8B, 9B, 10B, and 11B, the comb sets can include indicia (shown as I, II, III, IIII in the example configuration) to indicate its thickness and stubble length. Any suitable indicia can be used, such as a numbers, letters, colors, symbols, and combinations thereof. Further, the comb units can be configured such that they can be attached to the first long hair cutter unit in either of a first position and a second position, where the comb unit is rotated by 180 degree around the z axis in the second position relative to the first position.

While FIGS. 1-11B depict one example type of beard trimmer 102 having long hair cutter units with associated comb units, similar long hair cutter units and/or comb units can be utilized with a variety of other grooming and styling devices without departing from the scope of the present disclosure. For instance, in some configurations, a comb unit similar to the comb units described above can be used with a dry electric shaver having a single cutting unit, as opposed to the dual cutting units described above. In other configurations, a comb unit similar to the comb units described above can be used with grooming devices that are combined wet and dry shavers, with the comb unit attachable to the dry shaver portion. Comb units may also be used with dry shavers having more or less movability that the beard trimmer 102 describe above, such as dry shavers having a head that is movable in two or three dimensions (i.e., a swivel and/or tilting head). As is to be appreciated, comb units similar to those described above can also be used with beard trimmers having exchangeable heads, with at least one of the heads having at least one cutting unit to which the comb unit may be attached. Described in more detail below with regard to FIGS. 9-11 is a beard trimmer having rotary cutter units to which comb units may be attached.

Figure 12:
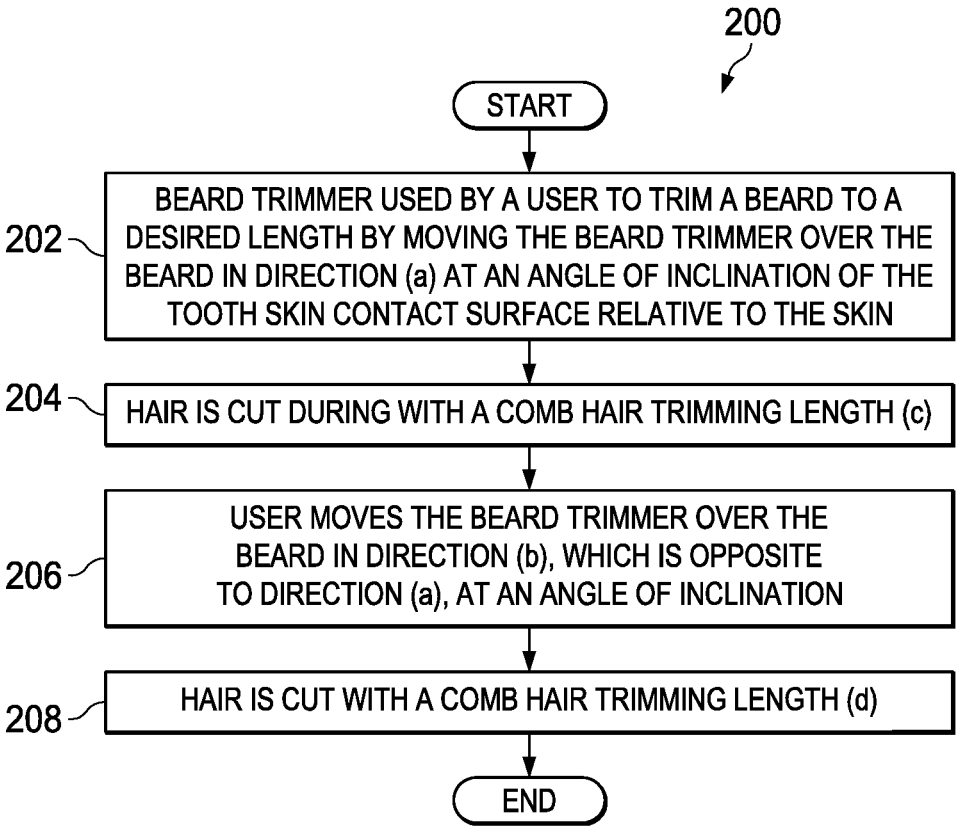
FIG. 12 is a flow chart of an example method of using a beard trimmer in accordance with one embodiment.

FIG. 12 is a flow chart 200 of an example method of using a beard trimmer. At block 202, the beard trimmer 102 is used by a user to trim a beard to a desired length by moving the beard trimmer 102 over the beard in direction (a) at an angle of inclination of the tooth skin contact surface 182 relative to the skin. At block 204, hair is cut during that movement with a comb hair trimming length (c). At block 206, the user moves the beard trimmer 102 over the beard in direction (b), which is opposite to direction (a), at an angle of inclination. The angle of inclination of the tooth skin contact surface 182 relative to the skin during movement in direction (a) and (b) is substantially maintained. At block 208, hair is cut during that movement with a comb hair trimming length (d). The comb hair trimming length (c) is substantially the same as the comb hair trimming length (d). More particularly, the first comb hair trimming length may be the same as the second comb hair trimming length with a tolerance of +/−0.4 mm. Additionally or alternatively, the angle of inclination of the tooth skin contact surface 182 relative to the skin during movement in direction (a) and (b) is maintained with a tolerance of +/−10 degrees. The handle 104 of the beard trimmer 102 may be oriented and held in the user's hand the same way relative to the user's skin during movement in both direction (a) and direction (b). The process then loops back to block 202.

Figure 13:
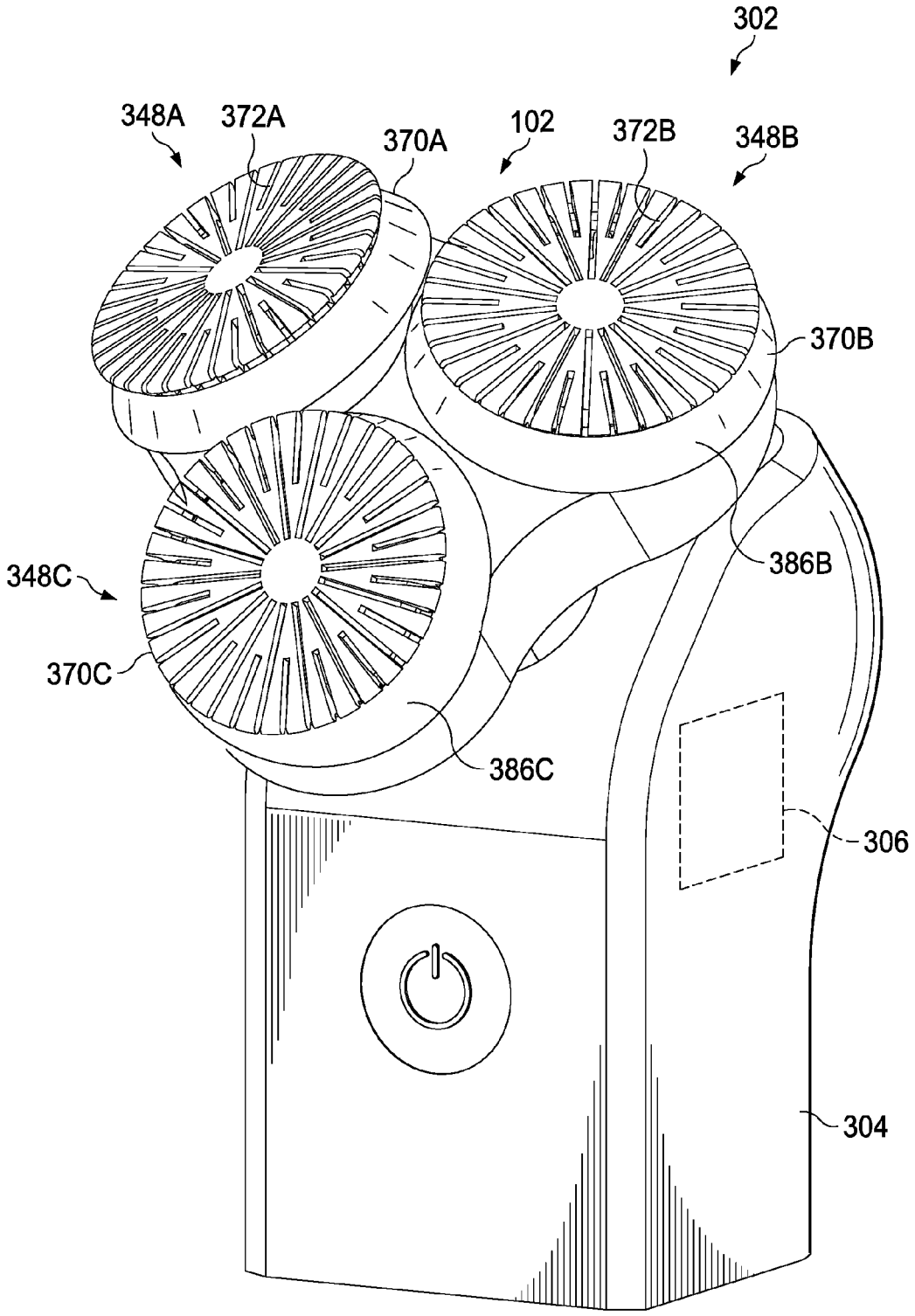
FIG. 13 is a front perspective view of a beard trimmer having rotary cutter units.
Figure 14:
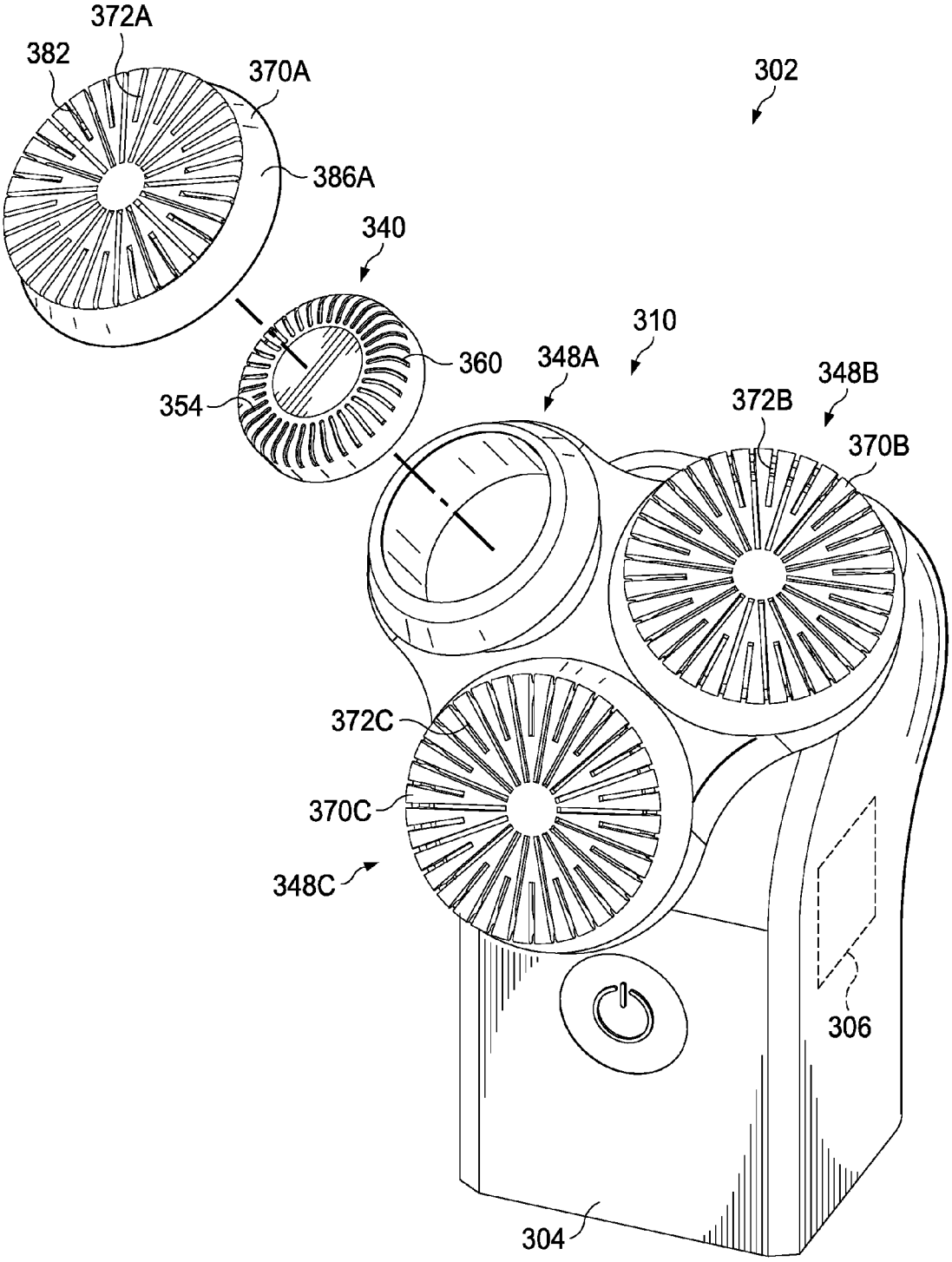
FIG. 14 is a partial exploded view of the beard trimmer of FIG. 13.
Figure 15:
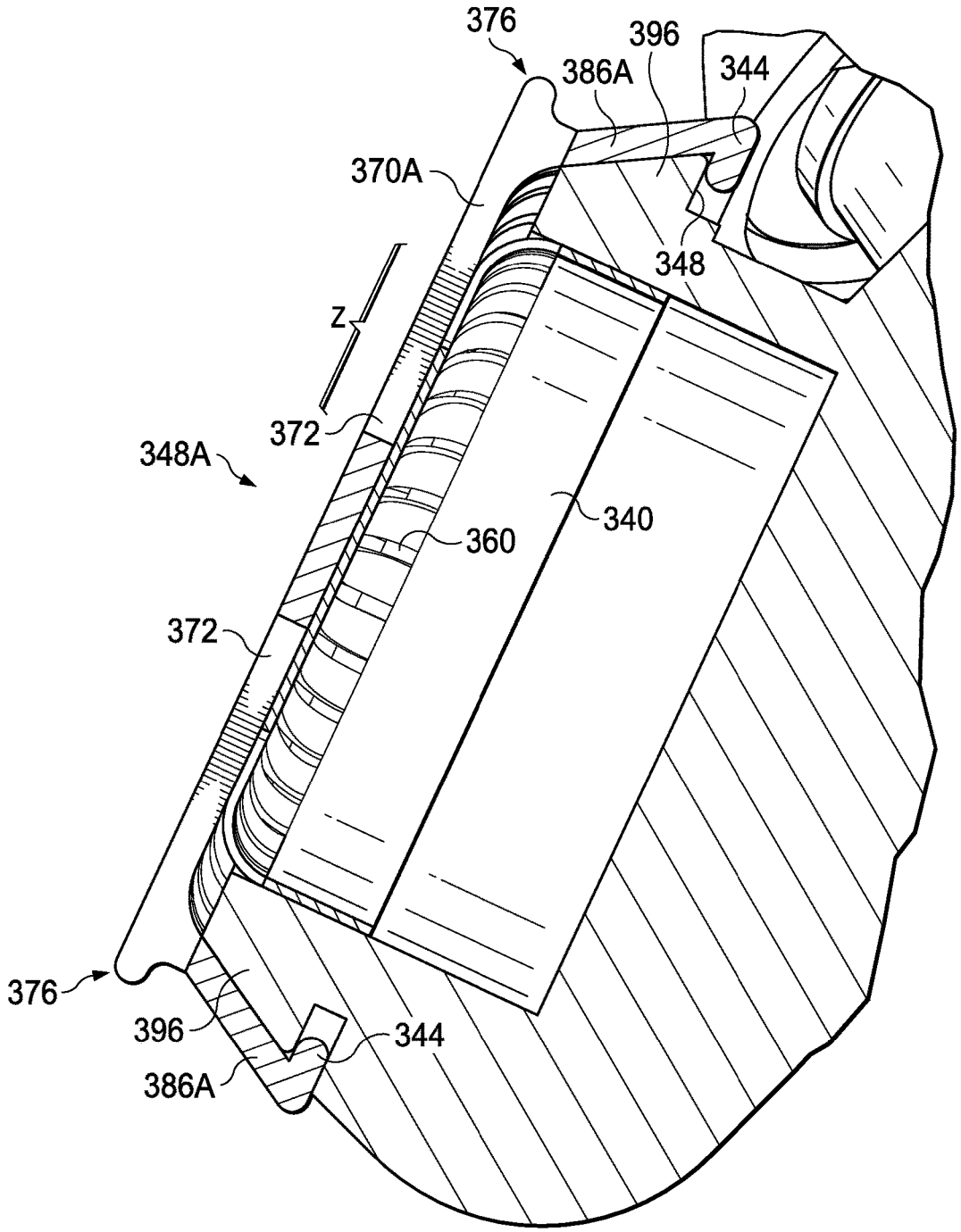
FIG. 15 is a partial cross-sectional view of a rotary cutter unit of the beard trimmer of FIG. 13.

FIGS. 13-15 depict a beard trimmer 302 comprising a handle 304 having rotary cutter units 348A-C positioned on a head portion 310. Each rotary cutter unit 348A-C has an outer cutter 340 and an inner cutter (not shown). The outer cutter 340 and/or the inner cutter of each of the rotary cutter units 348A-C are driven by a motor 306 of the beard trimmer 302 to rotate or oscillate in a rotary direction relative to each other. The outer cutter 340 has a cutter skin contact surface 354 and has multiple cutting slots 360 into which hair is fed during use. Through the arrangement and size of the multiple cutting slots 360, the outer cutter 340 and/or the inner cutter may be configured as long hair cutters, short hair cutters, or combination long hair and short hair cutters.

Similar to the first comb unit 171A described above, comb units 370A-C are releasably attachable to each of the rotary cutter units 348A-C, respectively. The comb teeth 372A-C on the comb units are circularly arranged and coupled to a circular wall 386A-C. Each tooth of the comb units 370A-C has a tooth skin contact surface, which is shown as tooth skin contact surface 382 for comb units 370A. The tooth skin contact surface 382 is at an elevated level relative to the cutter skin contact surface 354 so that the tooth skin contact surface 382 is suitable to be brought into skin contact. The teeth can be configured to direct hair into the rotary cutter units 348A-C, with outward tip portions 376 extending radially outward (FIG. 15). The tooth skin contact surface 382 prevents the cutter skin contact surface 354 to be brought into skin contact. Similar to the first comb unit 171A described above, a height difference of the tooth skin contact surface 382 relative to a cutting side of the outer cutter 340 defines a comb hair trimming length. Different sized comb units each having a different thickness may be selectively attached to the rotary cutter units 348A-C to provide for different comb hair trimming lengths.

The rotary cutter units 348A-C may be provided with a housing 396 which is made of a thermoplastic material. The comb units 370A-C may be selectably coupled to the rotary cutter units 348A-C, respectively, through any suitable type of connection, such as a snap fit connection. FIG. 11 depicts a cross-sectional view of the comb unit 370A connected to the rotary cutter unit 348A. The housing 396 has an annular shoulder 348 which is configured to engage with a latch portion 344 of the comb unit 370A. The latch portion 344 extends inwardly from the circular wall 386A such that once engaged with the annular shoulder 348, the relative position of the comb unit 370A to the rotary cutter unit 348A is maintained. Due to the similarity in configuration between the rotary cutter units 348A-C, the comb unit 171A may be interchangeable with the comb units 170B and 170C. In some implementations, the beard trimmer 302 is a component of a kit which also comprises a plurality of different sets of comb units. For instance, the kit may a total of nine comp units, with three comb units having a first thickness, three comb units having a second thickness, and three comb units each having a third thickness.

The comb teeth 372A-C of the comb units 370A-C may be more flexible when the comb units 370A-C are detached from the rotary cutter units 340A-C relative to the flexibility of the comb teeth 372A-C when the comb units 370A-C are attached to the rotary cutter units 340A-C. The comb units 370A-C may be adapted to allow for an amount of flexing of the comb teeth 372A-C in a comb teeth zone (shown as zone z in FIG. 11) of less than 0.6 mm, preferably less than 0.4 mm and more preferably less than 0.3 mm. The comb units 370A-C may be adapted to allow an amount of flexing of the comb teeth 372A-C in the comb teeth zone z which is located closest to a center of the respective outer cutters. Furthermore, the comb units 370A-C may be made of a suitable thermoplastic material, such as Polyoxymethylene, having an Elastic Modulus ranging between 1850 MPa and 3850 MPa or more preferably said Elastic Modulus is ranging between 2350 MPa and 3350 MPa.

Figure 16B:
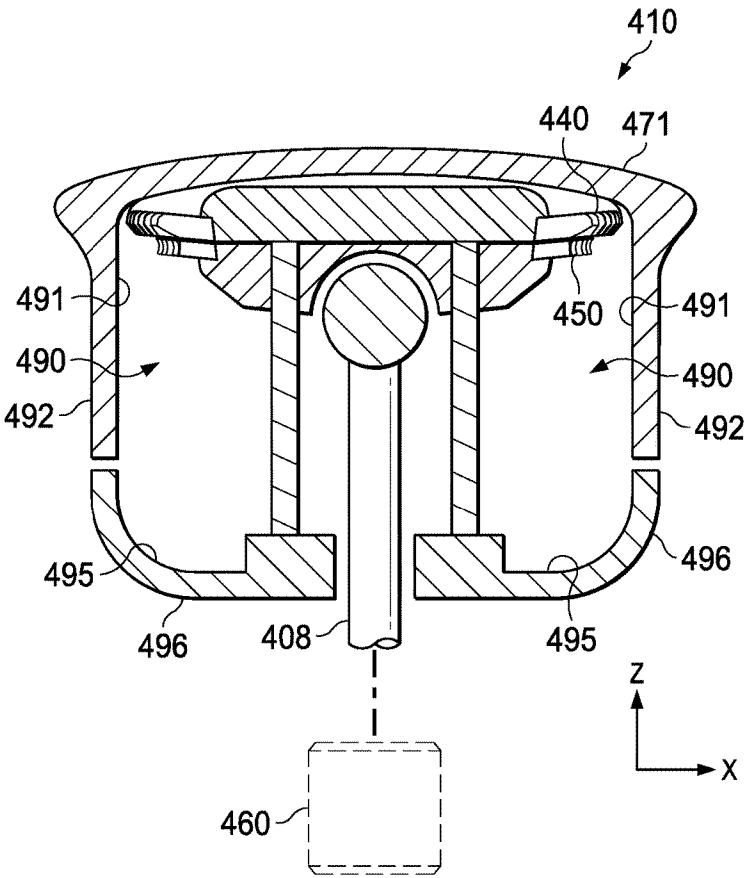
FIGS. 16A-16B are schematic cross-sectional views of an example head portion and a comb unit.
Figure 16A:
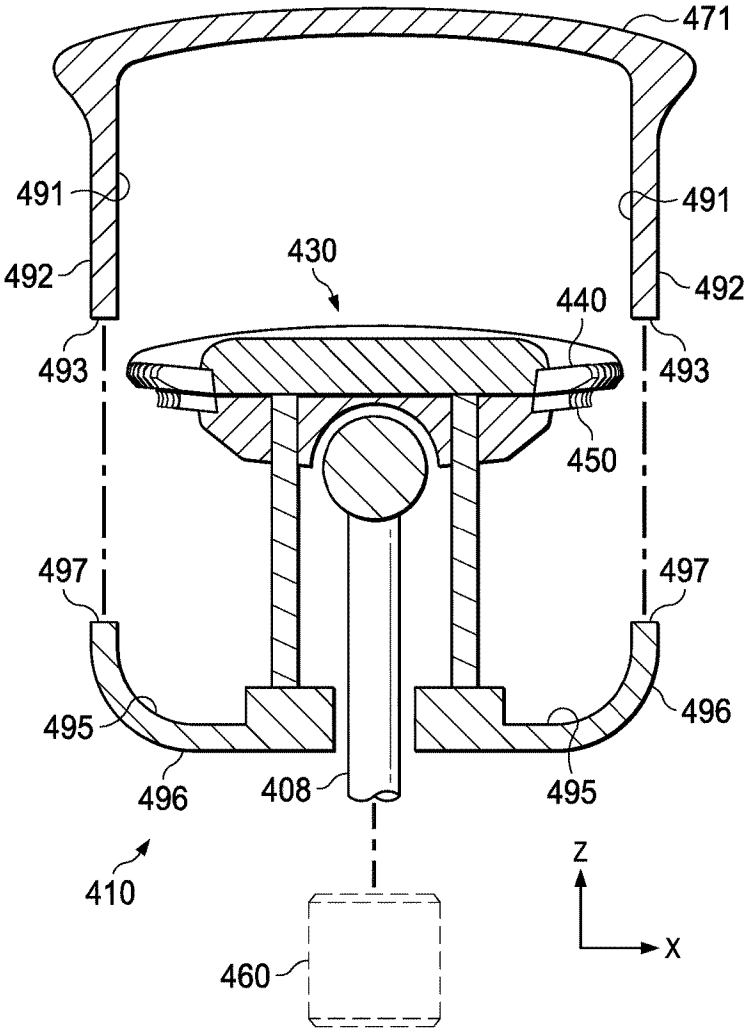

Referring now to FIGS. 16A-16B, schematic cross-sectional views of a head portion 410 and a comb unit 471 are depicted. Such head portion 410 can be associated with, for instance, a body groomer-style trimmer, flat beard trimmer, or other type of electric grooming implement. The head portion 410 may be attached to a suitable handle, similar to handle 104, for instance. As such, the head portion 410 may include a long hair cutter unit 430 having an outer cutter 440 stacked onto an inner cutter 450. A motor 460 may drive a drive shaft 408, which in turn drives one or both of the outer cutter 440 and the inner cutter 450 to oscillate relative to the other in a direction along an axis and cut hair between the inner cutter 450 and the outer cutter 440. Each of the outer cutter 440 and inner cutter 450 may have outwardly facing rows of teeth spanning the width and positioned on each side of the respective cutter. The head portion 410 depicted in FIG. 16A-16B also has a lower housing 496 positioned beneath the long hair cutter unit 460. The particular size, shape, and orientation of the lower housing 496 may vary. In some configurations, for instance, the outer lateral portions of the lower housing 496 bend upward, as shown, and define a lower housing rim 497. A comb unit 471, which may be similar to any of the comb units described above, may be selectively attached to the head portion 410. By attaching the comb unit 471 to the head portion 410, as shown in FIG. 16B, the hair trimming length can be increased. The comb unit 471 may utilize a snap-fit connection, or any other suitable type of connection. The comb unit 471 may include comb teeth (not shown) similar to the comb teeth described above, with the thickness of the comb teeth in the z direction contributing to the hair trimming length associated with the comb unit. The comb teeth may help to direct hairs into the long hair cutter unit 430. The comb unit 471 may also include a hair gap, similar to the hair gaps described above, which beneficially assists in providing the user with an improved hair trimming experience. Similar to the comb sets 170, 171, 173 and 175 shown in FIG. 7, a variety of different comb units may be selectively attached to the head portion 410, based on the user's desired trim length.

Referring to FIG. 16B, when the comb unit 471 is attached to the head portion 410 a hair collection box 490 is formed that is defined by an inner surface 491 of the sidewalls 492 and an inner surface 495 of the lower housing 496. In the illustrated configuration, the comb unit rim 493 (FIG. 16A) mates with, or least comes in close proximity to, the lower housing rim 497 (FIG. 16A) to generally form the box 490. During use, hair trimmed by the oscillating teeth of the inner cutter 450 and/or outer cuter 440 may be collected within the box 490. A user can empty the contents of the box 490 by detaching the comb unit 471 from the head portion 410.

Figure 17B:
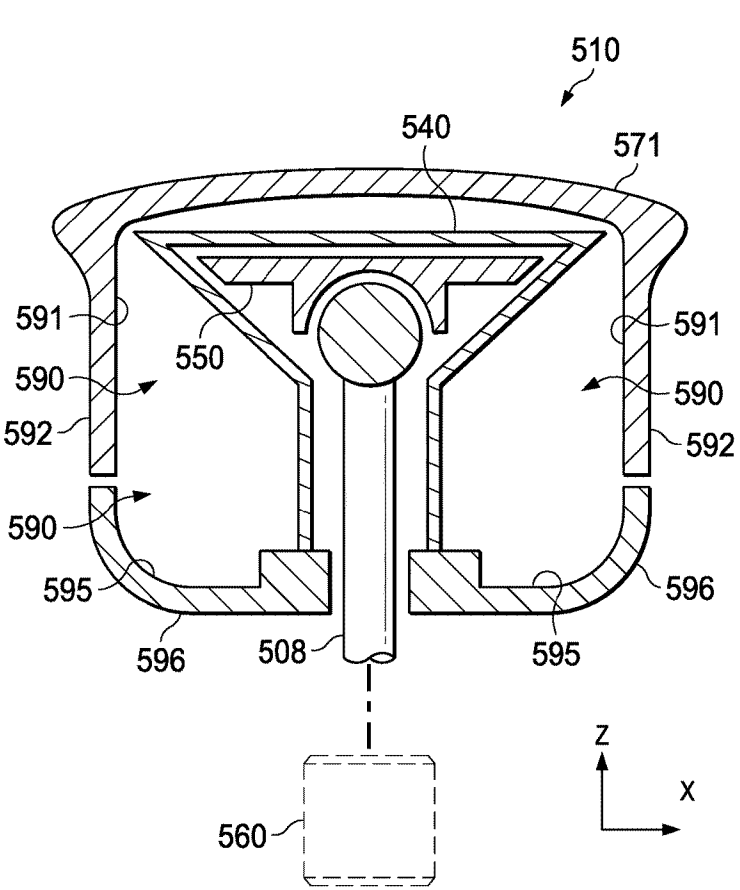
FIGS. 17A-17B are schematic cross-sectional views of another example head portion and a comb unit.
Figure 17A:
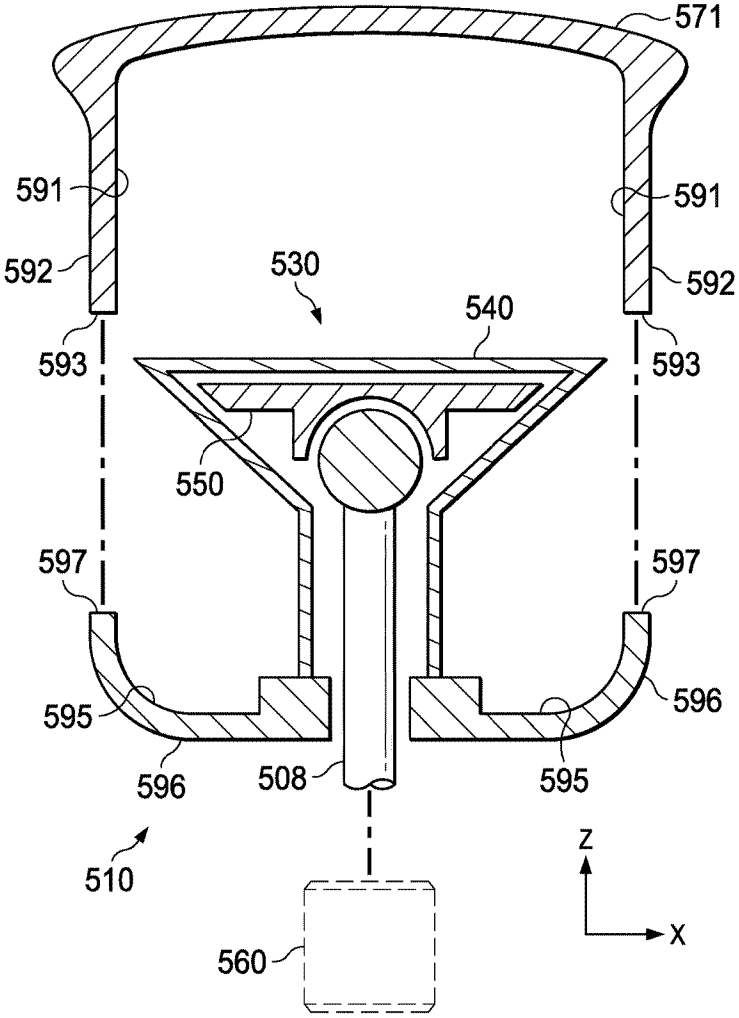

FIGS. 17A-17B are schematic cross-sectional views of another example head portion 510 and comb unit 571. Similar to the comb unit 471, the comb unit 571 may have rows of teeth with a hair gap positioned therebetween. The comb unit 571 may also have side walls 592 having an inner surface 591 that defines part of a hair collection box 590 when the comb unit 571 is attached to the head portion 510. Similar to the head portion 410, the head portion 510 includes drive shaft 508 driven by a motor 560. A lower housing 596 of the head portion 510 may have an inner surface 595 that defines a lower part of the box 590 when the comb unit 571 is attached to the head portion 510. The head portion 510 also includes a long hair cutter unit 530 having an outer cutter 540 stacked onto an inner cutter 550. In this configuration, however, the outer cutter 540 wraps around the inner cutter 550, such that the outer cutter 540 forms part of the box 590. The comb unit 571 has side walls 592 that may define a comb unit rim 593 that is sized to mate with, or least comes in close proximity to, a lower housing rim 597 when the comb unit 571 is attached to the head portion 510. Similar to the comb sets 170, 171, 173 and 175 shown in FIG. 7, a variety of different comb units may be selectively attached to the head portion 510, based on the user's desired trim length.

Figure 18B:
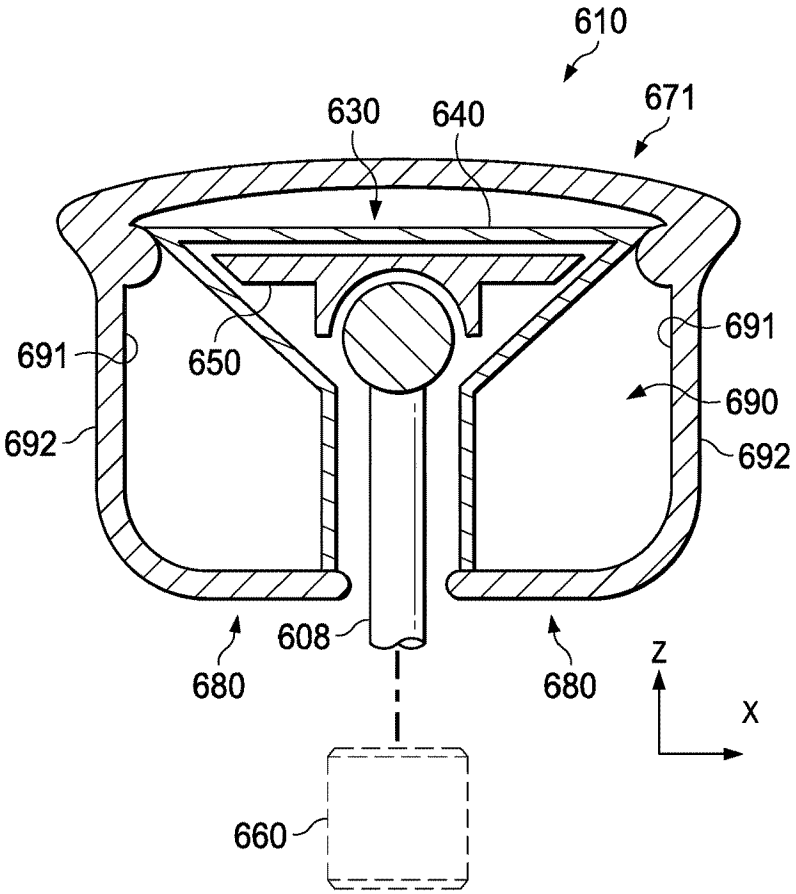
FIG. 18B is a schematic cross-sectional view of the comb unit of FIG. 18A attached to an example head portion.
Figure 18A:
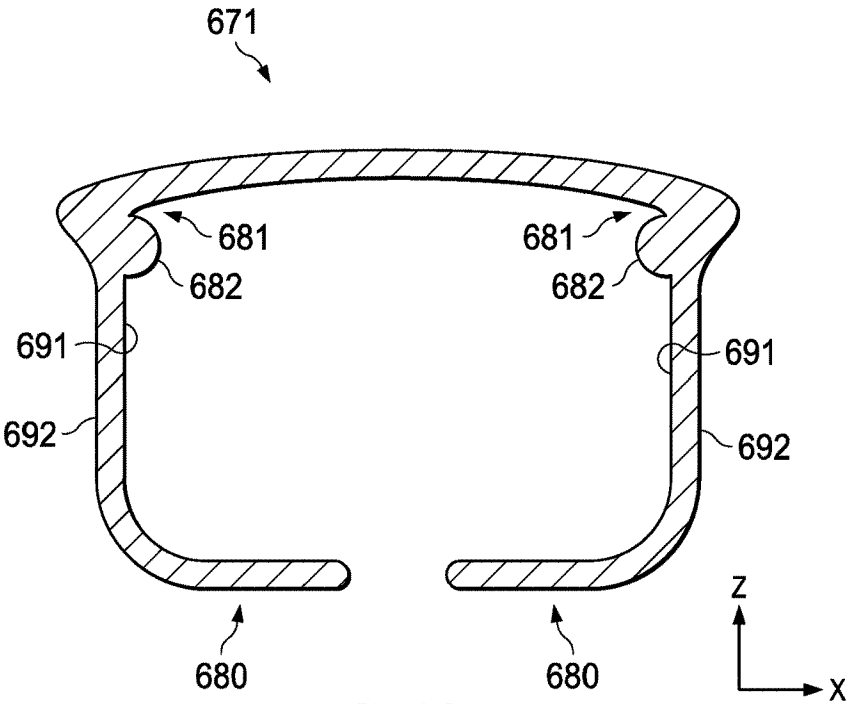
FIG. 18A is a schematic cross-sectional view of an example comb unit.

FIGS. 18A-18B depict cross-sectional view of another example configuration of a comb unit 671 that is selectively attachable to a head portion 610 of a beard trimmer or other type of body groomer. Similar to the head portion 510, the head portion 610 (FIG. 18B) has a long hair cutter 630 having an outer cutter 640 that wraps around an inner cutter 650. The inner cutter 650 may be oscillated by a drive shaft 608 of a motor 660. As is to be appreciated, however, other configurations of cutters can be used, such as the long hair cutter unit 430. The comb unit 671 has sidewalls 692 extend downward and include bottom portions 680 that curve inward. Instead of pressing the comb unit down onto the long hair cutter unit, like some of the configurations described above, the comb unit 671 is configured to be slid onto the long hair cutter 630 from the side. Further, an inner surface 691 may define a groove 681 that is configured to aid alignment of the comb unit 671 with the head portion 610. As shown in FIG. 18B, outer portions of the cutter 640 may be received into the groove 681 when the comb unit 671 is attached to the head portion 610. While the comb unit 671 in the illustrated configuration utilizes protrusions 681 to form the groove 681, any suitable technique can be used. When the comb unit 671 is slid onto the comb unit 671, a box 690 is formed to collect trimmed hairs. As shown in FIG. 18B, the box 690 may be defined by the inner surface 691 of the side walls 692 and a portion of the outer cutter 640.

The dimensions and/or values disclosed herein are not to be understood as being strictly limited to the exact numerical dimensions and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A beard trimmer having a handle, a motor and a head portion, wherein the head portion comprises at least a rotary cutting unit for trimming hair that is provided with a first outer cutter and a first inner cutter, the first outer cutter is provided with a cutter skin contact surface and a cutting side which is opposite to the skin contact surface, the motor rotationally drives one or both of the first inner cutter and the first outer cutter in order to rotate relative to the other and suitable to cut hair between the first inner cutter and the first outer cutter wherein a comb unit is releasably attached to the rotary cutting unit, the comb unit comprises comb teeth wherein each of the comb teeth has a tooth skin contact surface, the tooth skin contact surface being at an elevated level relative to the cutter skin contact surface so that the tooth skin contact surface is suitable to be brought in a skin contact and prevents the cutter skin contact surface to be brought in skin contact, a height difference of the tooth skin contact surface relative to the cutting side of the outer cutter defines a comb hair trimming length, and the comb teeth are more flexible when the comb unit is detached from the rotary cutting unit relative to the comb teeth being less flexible when the comb unit is attached to the rotary cutting unit, wherein the comb unit is coupled to the rotary cutter unit through a snap fit connection.

2. The beard trimmer of claim 1, wherein the comb unit is adapted to allow an amount of flexing of the comb teeth in a comb teeth zone of less than about 0.6 mm.

3. The beard trimmer of claim 1, wherein the comb unit is adapted to allow an amount of flexing of the comb teeth in a comb teeth zone of less than about 0.4 mm.

4. The beard trimmer of claim 1, wherein the comb unit is adapted to allow an amount of flexing of the comb teeth in a comb teeth zone of less than about 0.3 mm.

5. The beard trimmer of claim 1, wherein the comb unit is adapted to allow an amount of flexing of the comb teeth in a comb teeth zone which is located closest to a center of the outer cutter.

6. The beard trimmer of claim 1, wherein the comb unit is provided with an inner surface which faces the cutter skin contact surface and which is opposite to the tooth skin contact surface and wherein a distance between the cutter skin contact surface and the inner surface is below 0.6 mm.

7. The beard trimmer of claim 1, wherein the comb unit is provided with an inner surface which faces the cutter skin contact surface and which is opposite to the tooth skin contact surface and wherein a distance between the cutter skin contact surface and the inner surface is below 0.4 mm.

8. The beard trimmer of claim 1, wherein the comb unit is provided with an inner surface which faces the cutter skin contact surface and which is opposite to the tooth skin contact surface and wherein a distance between the cutter skin contact surface and the inner surface is below 0.3 mm.

9. The beard trimmer according to claim 1, wherein the comb unit comprises a circular wall, wherein the comb teeth are integrally connected with each other by the circular wall and wherein the circular wall is surrounding the sides of the rotary cutting unit.

10. The beard trimmer according to claim 1, wherein the comb unit is releasably attached to the rotary cutting unit and/or the head portion is releasably attached to the handle.

11. The beard trimmer according to claim 1, wherein the first inner cutter and/or the first outer cutter are driven by the motor to rotate in a rotary direction relative to each other and wherein the comb teeth of the comb unit are circularly arranged.

12. The beard trimmer according to claim 1, wherein the comb unit is made of a thermoplastic material and more preferably the comb unit is made from Polyoxymethylene.

13. The beard trimmer according to claim 1, wherein the comb unit is made of a material having an Elastic Modulus ranging between about 1850 MPa and about 3850 MPa.

14. The beard trimmer according to claim 1, wherein the comb unit is made of a material having an Elastic Modulus ranging between about 2350 MPa and about 3350 MPa.

* * * * *